US009476263B2

(12) United States Patent
Clausen et al.

(10) Patent No.: US 9,476,263 B2
(45) **Date of Patent: *Oct. 25, 2016**

(54) ROTARY STEERABLE PUSH-THE-BIT DRILLING APPARATUS WITH SELF-CLEANING FLUID FILTER

(71) Applicant: National Oilwell Varco, L.P., Houston, TX (US)

(72) Inventors: Jeffery Ronald Clausen, Houston, TX (US); Jonathan Ryan Prill, Edmonton (CA)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 161 days.

This patent is subject to a terminal disclaimer.

(21) Appl. No.: 14/494,696

(22) Filed: Sep. 24, 2014

(65) Prior Publication Data

US 2015/0008043 A1 Jan. 8, 2015

Related U.S. Application Data

(63) Continuation of application No. 13/733,703, filed on Jan. 3, 2013, now Pat. No. 8,869,916, which is a continuation-in-part of application No. 13/229,643, filed on Sep. 9, 2011, now Pat. No. 9,016,400.

(60) Provisional application No. 61/381,243, filed on Sep. 9, 2010, provisional application No. 61/410,099, filed on Nov. 4, 2010.

(51) Int. Cl.

| | |
|---|---|
| ***E21B 7/06*** | (2006.01) |
| ***E21B 17/10*** | (2006.01) |
| ***E21B 10/32*** | (2006.01) |

(52) U.S. Cl.

CPC ..... *E21B 17/1014* (2013.01); *E21B 7/06* (2013.01); *E21B 10/322* (2013.01)

(58) Field of Classification Search

CPC .. E21B 17/1014; E21B 10/322; E21B 10/32; E21B 7/06; E21B 17/10

See application file for complete search history.

(56) References Cited

U.S. PATENT DOCUMENTS

| | | | |
|---|---|---|---|
| 2,579,670 | A | 12/1951 | George |
| 2,942,578 | A | 6/1960 | Huffman et al. |

(Continued)

FOREIGN PATENT DOCUMENTS

| | | | |
|---|---|---|---|
| CA | 1144916 | A1 | 4/1983 |
| CA | 2011972 | A1 | 9/1990 |

(Continued)

OTHER PUBLICATIONS

European Search Report dated Oct. 24, 2014; European Application No. 11822954.1 (6 p.).

(Continued)

*Primary Examiner* — Kenneth L Thompson
*Assistant Examiner* — Wei Wang
(74) *Attorney, Agent, or Firm* — Conley Rose, P.C.

(57) ABSTRACT

A steerable drilling apparatus includes a control system inside a cylindrical housing connected to a drill bit having radially-extendable pistons. A fluid-metering assembly directs a piston-actuating fluid into fluid channels leading to respective pistons. The control system controls the fluid-metering assembly to allow fluid flow to selected pistons, causing the actuated pistons to temporarily extend in the opposite direction to a desired wellbore deviation, thereby deflecting the drill bit away from the borehole centerline. An upper member in the fluid-metering assembly can be moved to stabilize, steer, and change TFA within the drill bit. The control system and drill bit are connected so as to facilitate removal to change the drill bit's steering section and cutting structure configuration or gauge simultaneously. The apparatus may incorporate a fluid filter module mounted to the control system. The pistons may incorporate auxiliary cutting elements to provide near-bit reaming capability.

23 Claims, 33 Drawing Sheets

(56) References Cited

U.S. PATENT DOCUMENTS

| | | | |
|---|---|---|---|
| 3,030,930 | A | 4/1962 | Louis |
| 3,089,551 | A | 5/1963 | Greene |
| 3,092,188 | A | 6/1963 | Farris et al. |
| 3,195,660 | A | 7/1965 | McKown |
| 3,298,449 | A | 1/1967 | Bachman et al. |
| 3,424,256 | A | 1/1969 | Jeter et al. |
| 3,488,765 | A | 1/1970 | Anderson |
| 3,502,002 | A | 3/1970 | Whiteman, Jr. |
| 3,780,622 | A | 12/1973 | Vogel |
| 3,880,051 | A | 4/1975 | Eppler |
| 3,913,488 | A | 10/1975 | Dunetz et al. |
| 3,973,472 | A | 8/1976 | Russell, Jr. |
| 3,997,008 | A | 12/1976 | Kellner |
| 4,040,494 | A | 8/1977 | Kellner |
| 4,096,911 | A | 6/1978 | Geske |
| 4,281,723 | A | 8/1981 | Edmond et al. |
| 4,336,850 | A | 6/1982 | Fielder |
| 4,394,881 | A | 7/1983 | Shirley |
| 4,460,324 | A | 7/1984 | Van Appledorn |
| 4,532,853 | A | 8/1985 | Stangroom |
| 4,610,318 | A | 9/1986 | Goodfellow |
| 4,635,736 | A | 1/1987 | Shirley |
| 4,690,229 | A | 9/1987 | Raney |
| 4,721,172 | A | 1/1988 | Brett et al. |
| 4,819,745 | A | 4/1989 | Walter |
| 5,181,576 | A | 1/1993 | Askew et al. |
| 5,265,682 | A | 11/1993 | Russell et al. |
| 5,265,684 | A | 11/1993 | Rosenhauch |
| 5,293,945 | A | 3/1994 | Rosenhauch et al. |
| 5,311,953 | A | 5/1994 | Walker |
| 5,334,062 | A | 8/1994 | Lurbiecki |
| 5,379,852 | A | 1/1995 | Strange, Jr. |
| 5,421,420 | A | 6/1995 | Malone et al. |
| 5,467,834 | A | 11/1995 | Hughes et al. |
| 5,511,627 | A | 4/1996 | Anderson |
| 5,513,713 | A | 5/1996 | Groves |
| 5,520,255 | A | 5/1996 | Barr et al. |
| 5,520,256 | A | 5/1996 | Eddison |
| 5,542,482 | A | 8/1996 | Eddison |
| 5,553,678 | A | 9/1996 | Barr et al. |
| 5,582,260 | A | 12/1996 | Murer et al. |
| 5,704,284 | A | 1/1998 | Stollenwerk |
| 5,706,905 | A | 1/1998 | Barr |
| 5,775,443 | A | 7/1998 | Lott |
| 5,778,992 | A | 7/1998 | Fuller |
| 5,803,185 | A | 9/1998 | Barr et al. |
| 5,971,085 | A | 10/1999 | Colebrook |
| 6,092,610 | A | 7/2000 | Kosmala et al. |
| 6,109,372 | A | 8/2000 | Dorel et al. |
| 6,158,529 | A | 12/2000 | Dorel |
| 6,158,533 | A | 12/2000 | Gillis et al. |
| 6,196,339 | B1 | 3/2001 | Portwood et al. |
| 6,254,275 | B1 | 7/2001 | Slaughter, Jr. et al. |
| 6,279,670 | B1 | 8/2001 | Eddison et al. |
| 6,290,003 | B1 | 9/2001 | Russell |
| 6,315,063 | B1 | 11/2001 | Martini |
| 6,318,481 | B1 | 11/2001 | Schoeffler |
| 6,390,192 | B2 | 5/2002 | Doesburg et al. |
| 6,390,212 | B1 | 5/2002 | Wood |
| 6,408,957 | B1 | 6/2002 | Slaughter et al. |
| 6,431,292 | B2 | 8/2002 | Mocivnik et al. |
| 6,439,318 | B1 | 8/2002 | Eddison et al. |
| 6,484,823 | B2 | 11/2002 | Olsson et al. |
| 6,516,900 | B1 | 2/2003 | Tokle |
| 6,520,254 | B2 | 2/2003 | Hurst et al. |
| 6,520,271 | B1 | 2/2003 | Martini |
| 6,571,679 | B2 | 6/2003 | Atkinson |
| 6,571,888 | B2 | 6/2003 | Comeau et al. |
| 6,609,579 | B2 | 8/2003 | Krueger et al. |
| 6,626,254 | B1 | 9/2003 | Krueger et al. |
| 6,695,063 | B2 | 2/2004 | Lauritzen et al. |
| 6,715,570 | B1 | 4/2004 | Downton et al. |
| 6,789,624 | B2 | 9/2004 | McGregor et al. |
| 6,840,336 | B2 | 1/2005 | Schaaf et al. |
| 6,843,319 | B2 | 1/2005 | Tran et al. |
| 6,848,518 | B2 | 2/2005 | Chen et al. |
| 6,851,475 | B2 | 2/2005 | Simpson et al. |
| 6,962,214 | B2 | 11/2005 | Hughes et al. |
| 6,997,272 | B2 | 2/2006 | Eppink |
| 7,004,263 | B2 | 2/2006 | Moriarty et al. |
| 7,004,266 | B2 | 2/2006 | Russell et al. |
| 7,028,789 | B2 | 4/2006 | Krueger et al. |
| 7,040,395 | B2 | 5/2006 | Booth |
| 7,048,061 | B2 | 5/2006 | Bode et al. |
| 7,090,033 | B2 | 8/2006 | Chan et al. |
| 7,100,690 | B2 | 9/2006 | Mullen et al. |
| 7,188,687 | B2 | 3/2007 | Rudd et al. |
| 7,243,740 | B2 | 7/2007 | Frith |
| 7,275,605 | B2 | 10/2007 | Smith et al. |
| 7,287,605 | B2 | 10/2007 | Van Steenwyk et al. |
| 7,306,060 | B2 | 12/2007 | Krueger et al. |
| 7,308,944 | B2 | 12/2007 | Johnston et al. |
| 7,360,609 | B1 | 4/2008 | Falgout, Sr. |
| 7,389,830 | B2 | 6/2008 | Turner et al. |
| 7,413,034 | B2 | 8/2008 | Kirkhope et al. |
| 7,503,405 | B2 | 3/2009 | Hall et al. |
| 7,555,978 | B2 | 7/2009 | Hiez et al. |
| 7,644,766 | B2 | 1/2010 | Begley et al. |
| 7,681,665 | B2 | 3/2010 | Eppink |
| 7,708,062 | B2 | 5/2010 | Carro |
| 7,730,972 | B2 | 6/2010 | Hall et al. |
| 7,748,463 | B2 | 7/2010 | Revheim |
| 7,757,781 | B2 | 7/2010 | Hay et al. |
| 7,810,585 | B2 | 10/2010 | Downton |
| 7,832,476 | B2 | 11/2010 | Schafer et al. |
| 7,849,936 | B2 | 12/2010 | Hutton |
| 7,878,267 | B2 | 2/2011 | Southard |
| 7,878,272 | B2 | 2/2011 | Eppink |
| 7,926,592 | B2 | 4/2011 | Smith et al. |
| 7,931,098 | B2 | 4/2011 | Aronstam et al. |
| 7,942,214 | B2 | 5/2011 | Johnson et al. |
| 7,954,555 | B2 | 6/2011 | Ashy et al. |
| 7,971,662 | B2 | 7/2011 | Beuershausen |
| 8,011,452 | B2 | 9/2011 | Downton |
| 8,020,637 | B2 | 9/2011 | Hall et al. |
| 8,087,479 | B2 | 1/2012 | Kulkarni et al. |
| 8,100,199 | B2 | 1/2012 | Braddick |
| 8,104,549 | B2 | 1/2012 | Lee |
| 8,141,657 | B2 | 3/2012 | Hutton |
| 8,181,719 | B2 | 5/2012 | Bunney et al. |
| 8,205,686 | B2 | 6/2012 | Beuershausen |
| 8,240,399 | B2 | 8/2012 | Kulkarni et al. |
| 8,251,144 | B2 | 8/2012 | MacFarlane |
| 8,297,358 | B2 | 10/2012 | Korkmaz et al. |
| 8,302,703 | B2 | 11/2012 | Rolovic |
| 8,333,254 | B2 | 12/2012 | Hall et al. |
| 8,342,250 | B2 | 1/2013 | Blair et al. |
| 8,365,821 | B2 | 2/2013 | Hall et al. |
| 8,376,067 | B2 | 2/2013 | Downton et al. |
| 8,448,722 | B2 | 5/2013 | Konschuh et al. |
| 8,528,649 | B2 | 9/2013 | Kolle |
| 8,528,664 | B2 | 9/2013 | Hall et al. |
| 8,590,636 | B2 | 11/2013 | Menger |
| 8,672,036 | B2 | 3/2014 | Hughes et al. |
| 8,672,042 | B2 | 3/2014 | Braddick |
| 8,672,056 | B2 | 3/2014 | Clark et al. |
| 8,708,064 | B2 | 4/2014 | Downton et al. |
| 2002/0179336 | A1 | 12/2002 | Schaaf et al. |
| 2003/0015352 | A1 | 1/2003 | Robin et al. |
| 2003/0042022 | A1 | 3/2003 | Lauritzen et al. |
| 2004/0118571 | A1 | 6/2004 | Lauritzen et al. |
| 2006/0027798 | A1 | 2/2006 | Winston |
| 2006/0130643 | A1 | 6/2006 | Frank |
| 2006/0157281 | A1 | 7/2006 | Downton |
| 2006/0231291 | A1 | 10/2006 | Johannessen |
| 2006/0254825 | A1 | 11/2006 | Krueger et al. |
| 2009/0126936 | A1 | 5/2009 | Begley et al. |
| 2009/0133931 | A1 | 5/2009 | Rolovic |
| 2009/0260884 | A1 | 10/2009 | Santelmann |
| 2010/0006341 | A1 | 1/2010 | Downton |
| 2010/0163307 | A1 | 7/2010 | Schwefe et al. |
| 2010/0270079 | A1 | 10/2010 | Southard |
| 2011/0061938 | A1 | 3/2011 | Miszewski |
| 2011/0139513 | A1 | 6/2011 | Downton |

(56) References Cited

U.S. PATENT DOCUMENTS

| | | | |
|---|---|---|---|
| 2011/0240369 | A1 | 10/2011 | Hall et al. |
| 2011/0240377 | A1 | 10/2011 | Hall et al. |
| 2012/0061148 | A1 | 3/2012 | Clausen et al. |
| 2012/0067592 | A1 | 3/2012 | Niina et al. |
| 2012/0080234 | A1 | 4/2012 | Hall et al. |
| 2012/0168229 | A1 | 7/2012 | Lee |
| 2012/0175106 | A1 | 7/2012 | Rankin |
| 2012/0175168 | A1 | 7/2012 | Lee |
| 2012/0186878 | A1 | 7/2012 | Eddison |
| 2012/0261190 | A1 | 10/2012 | Krueger, IV et al. |
| 2013/0092246 | A1 | 4/2013 | Kolle |
| 2013/0118812 | A1 | 5/2013 | Clausen et al. |
| 2013/0133956 | A1 | 5/2013 | Jones et al. |
| 2013/0161102 | A1 | 6/2013 | Zhou |
| 2013/0206401 | A1 | 8/2013 | Bhoite et al. |
| 2013/0213646 | A1 | 8/2013 | Angman et al. |
| 2013/0255960 | A1 | 10/2013 | Fripp et al. |
| 2013/0277043 | A1 | 10/2013 | Hallundbaek et al. |
| 2013/0284428 | A1 | 10/2013 | Xu |
| 2013/0292175 | A1 | 11/2013 | Radford et al. |
| 2013/0306319 | A1 | 11/2013 | Kolle |
| 2014/0014413 | A1 | 1/2014 | Niina et al. |
| 2014/0020955 | A1 | 1/2014 | Cramer et al. |
| 2014/0041943 | A1 | 2/2014 | Lanning et al. |
| 2014/0048282 | A1 | 2/2014 | Dykstra et al. |
| 2014/0110178 | A1 | 4/2014 | Savage et al. |

FOREIGN PATENT DOCUMENTS

| | | | |
|---|---|---|---|
| CA | 1306244 | C | 8/1992 |
| CA | 2060445 | A1 | 8/1992 |
| CA | 2123700 | A1 | 6/1993 |
| CA | 2124442 | A1 | 6/1993 |
| CA | 2128903 | A1 | 6/1994 |
| CA | 2161312 | A1 | 5/1996 |
| CA | 2167795 | A1 | 7/1996 |
| CA | 2234495 | A1 | 10/1999 |
| CA | 2355815 | C | 11/2005 |
| CA | 2291600 | C | 4/2006 |
| CA | 2387299 | C | 4/2006 |
| CA | 2452907 | C | 7/2006 |
| CA | 2606428 | A1 | 11/2006 |
| CA | 2254044 | C | 3/2007 |
| CA | 2376823 | C | 5/2007 |
| CA | 2570716 | A1 | 6/2007 |
| CA | 2254741 | C | 7/2007 |
| CA | 2637410 | A1 | 7/2007 |
| CA | 2279338 | C | 8/2007 |
| CA | 2661518 | A1 | 4/2008 |
| CA | 2483812 | C | 9/2008 |
| CA | 2656848 | A1 | 9/2009 |
| CA | 2657012 | A1 | 9/2009 |
| CA | 2722762 | A1 | 10/2009 |
| CA | 2379806 | C | 11/2009 |
| CA | 2741618 | A1 | 5/2010 |
| CA | 2764300 | A1 | 12/2010 |
| CA | 2769937 | A1 | 2/2011 |
| CA | 2680895 | A1 | 3/2011 |
| CA | 2804747 | A1 | 1/2012 |
| CA | 2810266 | A1 | 3/2012 |
| CA | 2483174 | C | 4/2012 |
| CA | 2762538 | A1 | 6/2012 |
| CA | 2762559 | A1 | 6/2012 |
| CA | 2762607 | A1 | 6/2012 |
| CA | 2821835 | A1 | 6/2012 |
| CA | 2765055 | A1 | 7/2012 |
| CA | 2828745 | A1 | 10/2012 |
| CA | 2832212 | A1 | 10/2012 |
| CA | 2689578 | C | 12/2012 |
| CA | 2746918 | A1 | 1/2013 |
| CA | 2638234 | C | 6/2013 |
| CA | 2806898 | A1 | 8/2013 |
| CA | 2737504 | C | 9/2013 |
| CA | 2706850 | C | 10/2013 |
| CA | 2701474 | C | 12/2013 |
| CA | 2820491 | A1 | 12/2013 |
| CN | 2039734 | U | 6/1989 |
| CN | 1124515 | A | 6/1996 |
| EP | 0333484 | A2 | 9/1989 |
| EP | 0497422 | B1 | 6/1996 |
| EP | 0728907 | A2 | 8/1996 |
| EP | 0747570 | A1 | 12/1996 |
| EP | 0624225 | B1 | 3/1997 |
| EP | 0601811 | B1 | 10/1997 |
| EP | 0686752 | B1 | 5/2000 |
| EP | 0728911 | B1 | 7/2001 |
| EP | 0954674 | B1 | 9/2001 |
| EP | 0710764 | B1 | 7/2002 |
| EP | 1264960 | A2 | 12/2002 |
| EP | 1024245 | B1 | 10/2004 |
| EP | 1106777 | B1 | 3/2006 |
| EP | 1588021 | B1 | 8/2006 |
| EP | 1815104 | A1 | 8/2007 |
| EP | 0927295 | B1 | 3/2008 |
| EP | 1974120 | A1 | 10/2008 |
| EP | 2173960 | A1 | 4/2010 |
| EP | 2198109 | A2 | 6/2010 |
| EP | 1923534 | B1 | 11/2010 |
| EP | 2098680 | B1 | 7/2011 |
| EP | 2466058 | A1 | 6/2012 |
| EP | 1247787 | B1 | 10/2012 |
| EP | 2467556 | B1 | 6/2013 |
| EP | 2607616 | A1 | 6/2013 |
| EP | 2614209 | A1 | 7/2013 |
| GB | 2005773 | A | 4/1979 |
| GB | 2419616 | A | 5/2006 |
| WO | 2009/002996 | A1 | 12/2008 |
| WO | 2009/151786 | A2 | 12/2009 |

OTHER PUBLICATIONS

Mexican Office Action dated Jul. 15, 2015, for Mexican Application No. MX/a/2013/002663 (2 p.).

English Summary of Mexican Office Action for Mexican Application No. MX/a/2013/002663 (1 p.).

Chinese Office Action dated Jul. 16, 2014; Chinese Application No. 201180051342.0 (5 p.).

PCT/CA2011/001006 International Search Report and Written Opinion dated Dec. 28, 2011 (9 p.).

PCT/CA2011/001006 International Preliminary Report on Patentability dated Jan. 2, 2013 (10 p.).

U.S. Office Action dated Jun. 19, 2014; U.S. Appl. No. 13/229,643 (21 p.).

U.S. Response to Office Action dated Jun. 19, 2014; U.S. Appl. No. 13/229,643; Response filed Sep. 19, 2014 (20 p.).

Colebrook, M.A., et al., "Application of Steerable Rotary Drilling Technology to Drill Extended Reach Wells," 1998 IADC/SPE Drilling Conference, Dallas, Texas, Mar. 3-6, 1998 (SPE 39327) (11 p.).

PCT/US2013/069985 International Search Report and Written Opinion dated Nov. 13, 2014 (11 p.).

Australian Examination Report dated Mar. 30, 2016, for Australian Application No. 2011301169 (3 p.).

FIG. 14A
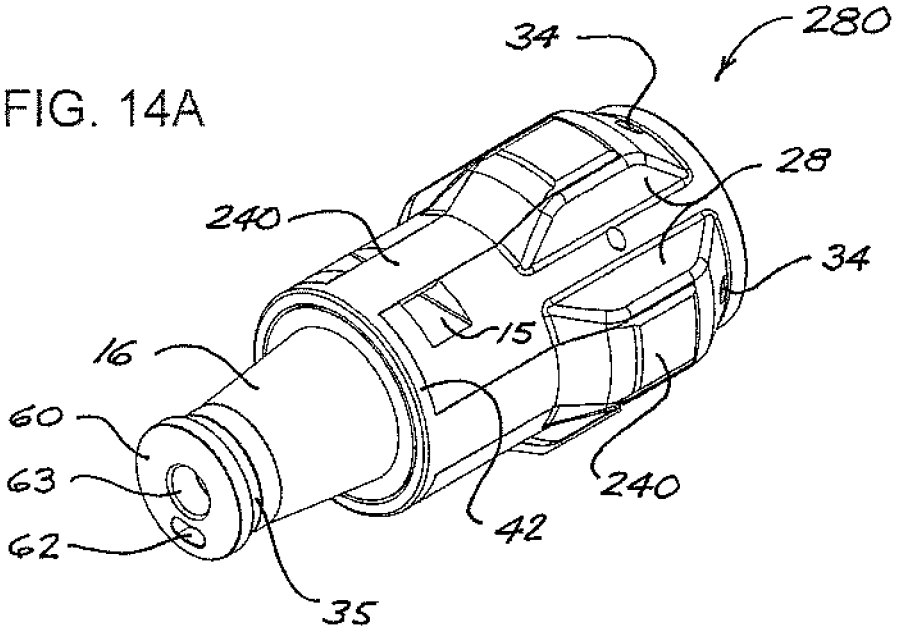
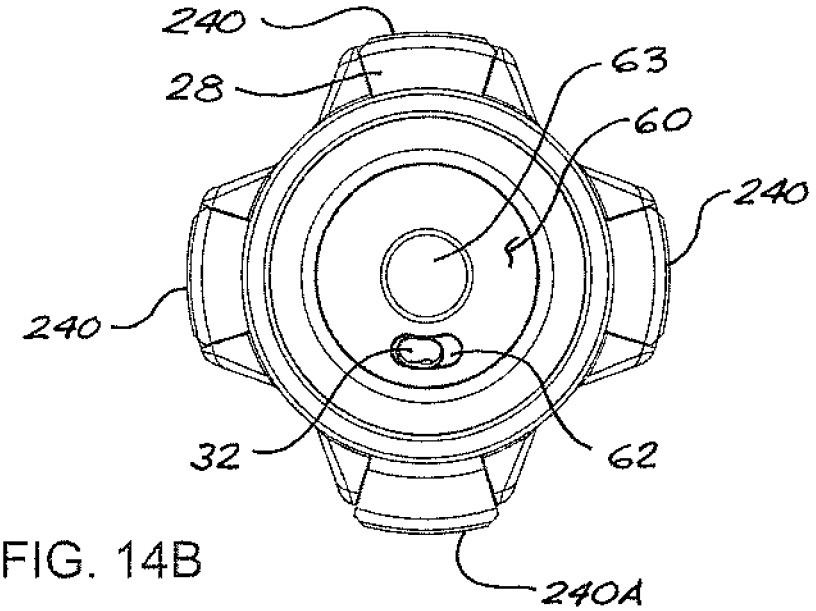
FIG. 14B

ROTARY STEERABLE PUSH-THE-BIT DRILLING APPARATUS WITH SELF-CLEANING FLUID FILTER

CROSS-REFERENCE TO RELATED APPLICATIONS

This application is a continuation of U.S. application Ser. No. 13/733,703 filed Jan. 3, 2013, entitled "Rotary Steerable Push-the-Bit Drilling Apparatus with Self-Cleaning Fluid Filter," which is a continuation-in-part of U.S. application Ser. No. 13/229,643, filed Sep. 9, 2011, and entitled "Downhole Rotary Drilling Apparatus with Formation-Interfacing Members and Control System," and further claims the benefit of U.S. provisional application Ser. No. 61/381,243 filed Sep. 9, 2010 and U.S. provisional application Ser. No. 61/410,099 filed Nov. 4, 2010, each of which is hereby incorporated herein by reference in its entirety.

STATEMENT REGARDING FEDERALLY SPONSORED RESEARCH OR DEVELOPMENT

Not applicable.

BACKGROUND

1. Field of the Disclosure

The present disclosure relates generally to systems and apparatus for directional drilling of wellbores, particularly for oil and gas wells.

2. Background of the Technology

Rotary steerable systems (RSS) currently used in drilling oil and gas wells into subsurface formations commonly use tools that operate above the drill bit as completely independent tools controlled from the surface. These tools are used to steer the drill string in a desired direction away from a vertical or other wellbore orientation, such as by means of steering pads or reaction members that exert lateral forces against the wellbore wall to deflect the drill bit relative to wellbore centerline. Most of these conventional systems are complex and expensive, and have limited run times due to battery and electronic limitations. They also require the entire tool to be transported from the well site to a repair and maintenance facility when parts of the tool break down. In addition, most conventional designs require large pressure drops across the tool for the tools to work well. Currently there is no easily separable interface between RSS control systems and formation-interfacing reaction members that would allow directional control directly at the bit.

There are two main categories of rotary steerable drilling systems used for directional drilling. In "point-the-bit" drilling systems, the orientation of the drill bit is varied relative to the centerline of the drill string to achieve a desired wellbore deviation. In "push-the-bit" systems, a lateral or side force is applied to the drill string (typically at a point several feet above the drill bit), thereby deflecting the bit away from the local axis of the wellbore to achieve a desired deviation.

Rotary steerable systems currently used for directional drilling focus on tools positioned uphole of the drill bit that either push the bit with a constant force several feet above the bit, or point the bit in order to steer the bit in the desired direction. Push-the-bit systems are simpler and more robust, but have limitations due to the applied side force being several feet from the bit and thus requiring the application of comparatively large forces to deflect the bit. Without being limited by this or any particular theory, the side force necessary to induce a given bit deflection (and, therefore, a given change in bit direction) increase as the distance between the side force and the bit increases.

Examples of conventional RSS systems may be found in U.S. Pat. No. 4,690,229 (Raney); U.S. Pat. No. 5,265,682 (Russell et al.); U.S. Pat. No. 5,513,713 (Groves); U.S. Pat. No. 5,520,255 (Barr et al.); U.S. Pat. No. 5,553,678 (Barr et al.); U.S. Pat. No. 5,582,260 (Murer et al.); U.S. Pat. No. 5,706,905 (Barr); U.S. Pat. No. 5,778,992 (Fuller); U.S. Pat. No. 5,803,185 (Barr et al.); U.S. Pat. No. 5,971,085 (Colebrook); U.S. Pat. No. 6,279,670 (Eddison et al.); U.S. Pat. No. 6,439,318 (Eddison et al.); U.S. Pat. No. 7,413,413,034 (Kirkhope et al.); U.S. Pat. No. 7,287,605 (Van Steenwyk et al.); U.S. Pat. No. 7,306,060 (Krueger et al.); U.S. Pat. No. 7,810,585 (Downton); and U.S. Pat. No. 7,931,098 (Aronstam et al.), and in Int'l Application No. PCT/US2008/068100 (Downton), published as Int'l Publication No. WO 2009/002996 A1.

Most conventional RSS designs typically require large pressure drops across the bit, thus limiting hydraulic capabilities in a given well due to increased pumping horsepower requirements for circulating drilling fluid through the apparatus. Point-the-bit systems may offer performance advantages over push-the-bit systems, but they require complex and expensive drill bit designs; moreover, they can be prone to bit stability problems in the wellbore, making them less consistent and harder to control, especially when drilling through soft formations.

A push-the-bit system typically requires the use of a filter sub run above the tool to keep debris out of critical areas of the apparatus. Should large debris (e.g., rocks) or large quantities of lost circulation material (e.g., drilling fluid) be allowed to enter the valve arrangements in current push-the-bit tool designs, valve failure is typically the result. However, filter subs are also prone to problems; should lost circulation material or rocks enter and plug up a filter sub, it may be necessary to remove (or "trip") the drill string and bit from the wellbore in order to clean out the filter.

For the foregoing reasons, there is a need in the art for rotary steerable push-the-bit drilling systems and apparatus that can deflect the drill bit to a desired extent applying lower side forces to the drill string than in conventional push-the-bit systems, while producing less pressure drop across the tool than occurs using known systems. There is also a need for rotary steerable push-the-bit drilling systems and apparatus that can operate reliably without needing to be used in conjunction with filter subs.

Push-the-bit RSS designs currently in use typically incorporate an integral RSS control system or apparatus for controlling the operation of the RSS tool. It is therefore necessary to disconnect the entire RSS apparatus from the drill string and replace it with a new one whenever it is desired to change bit sizes. This results in increased costs and lost time associated with bit changes. Accordingly, there is also a need in the art for push-the-bit RSS designs in which the RSS control apparatus is easily separable from the steering mechanism and can be used with multiple drill bit sizes.

There is a further need in the art for push-the-bit RSS systems and apparatus that can be selectively operated in either a first mode for directional drilling, or a second mode in which the steering mechanism is turned off for purposes of straight, non-deviated drilling. Such operational mode selectability will increase service life of the apparatus as well as the time between tool change-outs in the field. In addition, there is a need for such systems and apparatus that use a field-serviceable modular design, allowing the control system and components of the pushing system to be changed out in the field, thereby providing increased reliability and flexibility to the field operator, and at lower cost.

BRIEF SUMMARY OF THE DISCLOSURE

In general terms, the present disclosure teaches embodiments of push-the-bit rotary steerable drilling apparatus, also referred to as an "RSS tool," comprising a drill bit having a cutting structure, a pushing mechanism (or "steering section") for laterally deflecting the cutting structure by applying a side force to the drill bit, and a control assembly for actuating the pushing mechanism. As used herein, the term "drill bit" is to be understood as including both the cutting structure and the steering section, with the cutting structure being connected to the lower end of the steering section. The cutting structure may be permanently connected to or integral with the steering section, or may be releasably connected to the steering section.

The steering section of the drill bit houses one or more pistons, each having a radial stroke. The pistons are preferably, but not necessarily, uniformly circumferentially spaced about the bit, and adapted for extension radially outward from the main body of the steering section. In some embodiments, the pistons are adapted for direct contact with the wall of a wellbore drilled into a subsurface formation. In other embodiments, a reaction member, also referred to as a "reaction pad," is provided for each piston, with the outer surfaces of the reaction members lying in a circular pattern generally corresponding to the diameter (i.e., gauge) of the wellbore and the cutting structure of the drill bit. Each reaction member is mounted to the steering section so as to extend over at least a portion of the outer face of the associated piston, such that when a given piston is extended, it reacts against the inner surface of the corresponding reaction member. The outer surface of the reaction member in turn reacts against the wall of the wellbore, such that the side force induced by extension of the piston pushes or deflects the cutting structure in a direction away from the extended piston and toward the opposite side of the wellbore. The reaction members are mounted to the steering section in a non-rigid or resilient fashion so as to be outwardly deflectable relative to the steering section to induce lateral displacement of the cutting structure relative to the wellbore when a selected piston is actuated. The pistons may be biased to the retracted positions within the steering section, such as by means of biasing springs.

The steering section is formed with one or more fluid channels, corresponding in number to the number of pistons, and each extending between the radially-inward end of a corresponding piston to a fluid inlet at the upper end of the steering section, such that a piston-actuating fluid (e.g., drilling mud) can enter any given fluid channel to actuate the corresponding piston. The fluid channels continue downward past the pistons to allow fluid to exit into the wellbore through terminal bit jets.

The control assembly of the RSS tool is disposed within a housing having a lower end connected to the upper end of the steering section. A piston-actuating fluid such as drilling mud flows downward through the housing and around the steering section. The lower end of the control assembly engages and actuates a fluid-metering assembly (e.g., valve) for directing piston-actuating fluid to one (or more) of the pistons via the corresponding fluid channels in the steering section.

In one embodiment of the RSS tool, the fluid-metering assembly comprises a generally cylindrical upper sleeve member having an upper flange and a fluid-metering slot or opening in the sleeve below the flange. The fluid-metering assembly also comprises a lower sleeve having a center bore and defining the required number of fluid inlets, with each fluid inlet being open to the center bore via an associated recess in an upper region of the lower sleeve. The lower sleeve is mounted to or integral with the upper end of the steering section. The upper sleeve is disposable within the bore of the lower sleeve, with the slot in the upper sleeve at generally the same height as the recesses in the lower sleeve. The control assembly is configured to engage and rotate the upper sleeve within the lower sleeve, such that piston-actuating fluid will flow from the housing into the upper sleeve, and then will be directed via the slot in the upper sleeve into a recess with which the slot is aligned, and thence into the corresponding fluid inlet and downward within the corresponding fluid channel in the steering section to actuate (i.e., to radially extend) the corresponding piston.

The housing and the drill bit rotate with the drill string, but the control assembly is configured to control the rotation of the upper sleeve relative to the housing. To use the apparatus to deflect or deviate a wellbore in a specific direction, the control assembly controls the rotation of the upper sleeve to keep it in a desired angular orientation relative to the wellbore, irrespective of the rotation of the drill string. In this operational mode, the fluid-metering slot in the upper sleeve will remain oriented in a selected direction relative to the earth, i.e., opposite to the direction in which it is desired to deviate the wellbore. As the lower sleeve rotates below and relative to the upper sleeve, piston-actuating fluid is directed sequentially into each of the fluid inlets, thus actuating each piston to exert a force against the wall of the wellbore, thereby pushing and deflecting the cutting structure of the bit in the opposite direction relative to the wellbore. With each momentary alignment of the upper sleeve's fluid-metering slot with one of the fluid inlets, fluid flows into that fluid inlet and actuates the corresponding piston to deflect the cutting structure in the desired lateral direction (i.e., toward the side of the wellbore opposite the actuated piston). Accordingly, with each rotation of the drill string, the cutting structure is subjected to a number of momentary pushes corresponding to the number of fluid inlets and pistons.

In an alternative embodiment, the upper and lower sleeves are adapted and proportioned such that the upper sleeve is axially movable relative to the lower sleeve, between an upper position permitting fluid to flow into all fluid inlets simultaneously, an intermediate position permitting fluid flow into only one fluid inlet at a time, and a lower position preventing fluid flow into any of the fluid inlets (in which case all of the fluid simply continues to flow downward to the cutting structure through a central bore or channel in the steering section). When the apparatus is in this latter configuration, leakage of fluid to the pistons, if any, is generally insufficient to activate the pads even though the upper sleeve may be spinning.

During operation there can be a certain amount of constant fluid flow to each piston regardless of the relative positions of the upper and lower sleeves, as the fluid-metering assembly inherently provides a leak path to all pistons via their corresponding fluid channels in the steering section of the tool. The valve design may leaks due to the use of tight fits instead of sealing elements between the two mating sleeves. Any such leak path technically is between the two sleeve elements in the small annular space between the two mating sleeves. Fluid can flow from the downhole side up through the annular space due to pressure difference between the inside of the sleeve and the lower pressure in the inactive fluid channels (i.e., fluid channels not receiving fluid flow). There is also the possibility, albeit very slight, of leakage between the top mating faces. Slots or grooves may be provided on these mating sleeve areas to allow increased leakage to the fluid channels and related passages leading to the pistons to keep them clear of cuttings during operation.

However, fluid flow to the pistons is much less when the slot in the rotating upper sleeve is not aligned with the hole in the fixed lower sleeve. Optionally, grooved slots can be provided in the top face of the fixed lower sleeve to increase the minimum constant flow to the piston chambers regardless of the position of the rotating upper sleeve.

In another embodiment of the RSS tool, the fluid-metering assembly comprises an upper plate that is coaxially rotatable (by means of the control assembly) above a fixed lower plate incorporated into the upper end of the steering section, with the fixed lower plate defining the required number of fluid inlets, which are arrayed in a circular pattern concentric with the longitudinal axis (i.e., centerline) of the steering section, and aligned with corresponding fluid channels in the steering section. The upper and lower plates are preferably made from tungsten carbide or another wear-resistant material. The upper plate has a single fluid-metering opening extending through it, offset a radial distance generally corresponding to the radius of the fluid inlets in the fixed lower plate. As the tool housing and the drill bit rotate with the drill string, the control assembly controls the rotation of the upper plate to keep it in a desired angular orientation relative to the wellbore, irrespective of the rotation of the drill string.

The rotating upper plate lies immediately above and parallel to the fixed lower plate, such that when the fluid-metering opening in the upper plate is aligned with a given fluid inlet in the fixed lower plate, piston-actuating fluid flows through the fluid-metering opening in the upper plate and the aligned fluid inlet in the fixed lower plate, and into the corresponding fluid channel in the steering section. This fluid flow causes the corresponding piston to extend radially outward from the steering section such that it reacts against its reaction member (or reacts directly against the wellbore), thereby pushing and deflecting the cutting structure of the bit in the opposite direction.

The steering section of the drill bit is preferably releasably or removably connected to the control assembly (e.g., via a conventional pin-and-box threaded connection), with the rotating upper plate being incorporated into the control assembly. This facilitates field assembly of the components to complete the RSS tool at the drilling rig site, and facilitates quick drill bit changes at the rig site, either to use a different cutting structure, or to service the steering section, without having to remove the control assembly from the drill string.

To push the cutting structure in a desired direction relative to the wellbore, the control assembly is set to keep the fluid-metering opening oriented in the direction opposite to the desired pushing direction (i.e., direction of deflection). The drill bit is rotated within the wellbore, while the upper plate is non-rotating relative to the wellbore. With each rotation of the drill bit, the fluid-metering opening in the upper plate will pass over and be momentarily aligned with each of the fluid inlets in the fixed lower plate. Accordingly, when an actuating fluid is introduced into the interior of the tool housing above the upper plate, fluid flows into each fluid channel in turn during each rotation of the drill string.

With each momentary alignment of the upper plate's fluid-metering opening with one of the fluid inlets, fluid flows into that fluid inlet and actuates the corresponding piston to push (i.e., deflect) the cutting structure in the desired lateral direction (i.e., toward the side of the wellbore opposite the actuated piston). Accordingly, with each rotation of the drill string, the cutting structure is subjected to a number of momentary pushes corresponding to the number of fluid inlets and pistons.

By means of the control assembly, the direction in which the cutting structure is pushed can be changed by rotating the upper plate to give it a different fixed orientation relative to the wellbore. However, if it is desired to use the tool for straight (i.e., non-deviated) drilling, the tool can be put into a straight-drilling mode.

By having a side force applied directly at the drill bit, close to the cutting structure, rather than at a substantial distance above the bit as in conventional push-the-bit systems, bit steerability is enhanced, and the force needed to push the bit is reduced. Lower side forces at the bit, with a bit that is kept in line with the rest of the stabilized drill string behind, also increases stability and enhances repeatability in soft formations. As used herein, the term "repeatability" is understood as denoting the ability to repeatably achieve a consistent curve radius (or "build rate") for the trajectory of a wellbore in a given subsurface formation, independent of the strength of the formation. Without being limited by this or any particular theory, the greater the magnitude of the force applied against the wall of a wellbore by a piston in a push-the-bit drilling system, the greater will be the tendency for the piston to cut into softer formations and reduce the curvature of the trajectory of the wellbore (as compared to the effect of similar forces in harder formations). Accordingly, this tendency in softer formations is reduced by virtue of the lower piston forces required for equal effectiveness when using push-the-bit systems in accordance with embodiments described herein.

Push-the-bit rotary steerable drilling systems and apparatus in accordance with the principles described herein can be of modular design, such that any of the various components (e.g., pistons, reaction members, control assembly, and control assembly components) may be changed out in the field during bit changes. As previously noted, another advantageous feature of the embodiments described herein is that the rotating upper plate (or sleeve) of the fluid-metering assembly can be deactivated such that the tool will drill straight when deviation of the wellbore is not required, thereby promoting longer battery life (e.g., for battery-powered control assembly components) and extending the length of time that the tool can operate without changing batteries.

The control assembly for rotary steerable drilling apparatus in accordance with the principles described herein can be of any functionally suitable type. By way of one non-limiting example, the control assembly can be similar to or adapted from a fluid-actuated control assembly of the type in accordance with the vertical drilling system disclosed in International Application No. PCT/US2009/040983 (published as International Publication No. WO 2009/151786). In other embodiments, the control assembly can rotate the rotating upper plate or sleeve using, for example, an electric motor or opposing turbines.

Embodiments Incorporating Filter Module

Embodiments of rotary steerable drilling apparatus described herein having fluid-metering assemblies incorporating upper and lower sleeves may include a generally cylindrical filter module coaxially mounted between the lower end of the control assembly and the upper sleeve of the fluid-metering assembly, such that the filter module rotates with the control assembly and the upper sleeve. The filter module has a fluid passage, preferably but not necessarily in the form of a cylindrical bore, extending between an upper end in fluid communication with the annular space between the control assembly and the cylindrical housing of the apparatus, and a lower end in fluid communication with the bore of the upper sleeve of the fluid-metering assembly.

The filter module is axially movable within the housing (along with the control assembly), with an upper portion of the cylindrical outer surface of the main body of the filter module having a close tolerance tight fit within the bore of the housing, allowing passage of only very small particles. Adjacent a lower portion of the filter module body, the bore of the housing is increased in diameter, forming an annular space (or "filter annulus") between the cylindrical outer surface of the filter module body and the housing bore. Fluid ports are provided through the cylindrical wall of the filter module body, and one or more filter elements are provided within the fluid passage of the filter module to cover the fluid ports. In one embodiment, the fluid passage is a cylindrical bore, and the filter element is a cylindrical screen fitted against the cylindrical bore so as to cover all of the fluid ports.

In operation of the apparatus, drilling fluid flows from the housing annulus into the fluid passage of the filter module, with a portion of the fluid flow being diverted radially outward through fluid ports in the filter module body and into the filter annulus. The upper sleeve of the fluid-metering assembly is provided with a radial opening through which fluid can flow from the filter annulus sequentially into the recesses in the lower sleeve of the fluid-metering assembly as the upper sleeve/filter assembly rotates within the housing, and sequentially into the fluid channels in the steering section of the drill bit to sequentially actuate the pistons housed in the steering section. As with other embodiments not including a filter module, the upper sleeve is axially movable to selectively enable fluid flow to all or none of the pistons, as may be desired to suit operational requirements.

The filter module is effectively self-cleaning due to its geometry and due to the flow of fluid through the module's fluid passage. The majority of the fluid flow through the filter module is through the fluid passage, and any fluid containing particles larger than the filter screen mesh will flow into the main fluid channel in the steering section and onward to the bit nozzles. The high-velocity fluid flow through the fluid passage tends to remove any buildup on the filter element, such that it is carried into the steering section's main fluid channel. However, should the filter element nonetheless become plugged for some reason, a flow of fluid can still reach the filter annulus through the tolerance gap between the upper portion of the filter module and the housing bore. In this way, the tolerance gap serves as a secondary filter when the filter element is plugged.

The filter module is preferably connected to the upper sleeve of the fluid-metering assembly by means of a splined connection to provide torque transfer while also facilitating preloading or biasing in the downhole direction so that the upper and lower sleeves are kept in constant engagement. The preload can be provided by any functionally suitable means, such as but not limited to mechanical biasing means (such as a spring) or hydraulic biasing means.

The preloaded filter module accommodates significant misalignment during initial make-up of the bit pin with the box of the tool housing. The filter module moves upward until the upper and lower sleeves of the fluid-metering assembly become concentric as the pin continues to make up to the housing box. Once the parts are concentric, the spring (or other preload means) ensures that the upper sleeve is pushed into its properly seated position prior to initiation of fluid flow or rotation of the rotating sleeve. This arrangement reduces the risk of component damage during the procedure of stabbing the bit/lower sleeve assembly into the housing/upper sleeve assembly.

Embodiments Incorporating Auxiliary Cutting Elements

In other alternative embodiments, the pistons or piston pads of rotary steerable drilling apparatus may incorporate auxiliary cutting elements so as to provide the tool with near-bit reaming capability. The auxiliary cutting elements allow the tool to be used to open the borehole to a diameter larger than the effective bit diameter, by retracting the control assembly and upper sleeve of the fluid-metering assembly to allow fluid to actuate all of the pistons simultaneously, in situations where it is not desired or necessary to deviate the path of the borehole. This ability to increase the diameter of the borehole may be useful in situations where the drill bit has gone "under gauge" during drilling operations due to wear. In such a scenario, the operator could activate all of the pistons so that the cutting elements on the outer faces of the pistons (or on associated piston pads) will engage the wellbore to establish (or re-establish) a wellbore diameter equal to or greater than the as-new bit diameter.

Piston pads incorporating auxiliary cutting elements can be configured to both push or cut depending on the position of the rotating sleeve relative to the fixed sleeve valve. Through the use of non-aggressive cutting elements such as torque control components (TCCs) in the piston pads, the tool would still provide a side force when the control system and valve are in "steering mode" (i.e., activating one or a few pistons to push in a specific direction). When the control system and valve are retracted in the uphole direction, the cutters would be active to effectively ream the hole, as all the cutting elements would be active simultaneously. The auxiliary cutting elements may be provided in any functionally suitable form, such as (but not limited to) polycrystalline diamond compact (PDC) cutters, PDC buttons, or tungsten carbide buttons.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which numerical references denote like parts, and in which:

FIG. 14A is an isometric view of the steering section of the rotary drilling apparatus in FIG. 12, with a flexible reaction member mounted to the steering section in association with each piston.

FIG. 14B is a top end view of the apparatus in FIG. 14A, showing the upper and lower plates of the fluid-metering assembly, the piston housings, and the resiliently-mounted flexible reaction members.

DETAILED DESCRIPTION OF THE PREFERRED EMBODIMENTS

Figure 1:
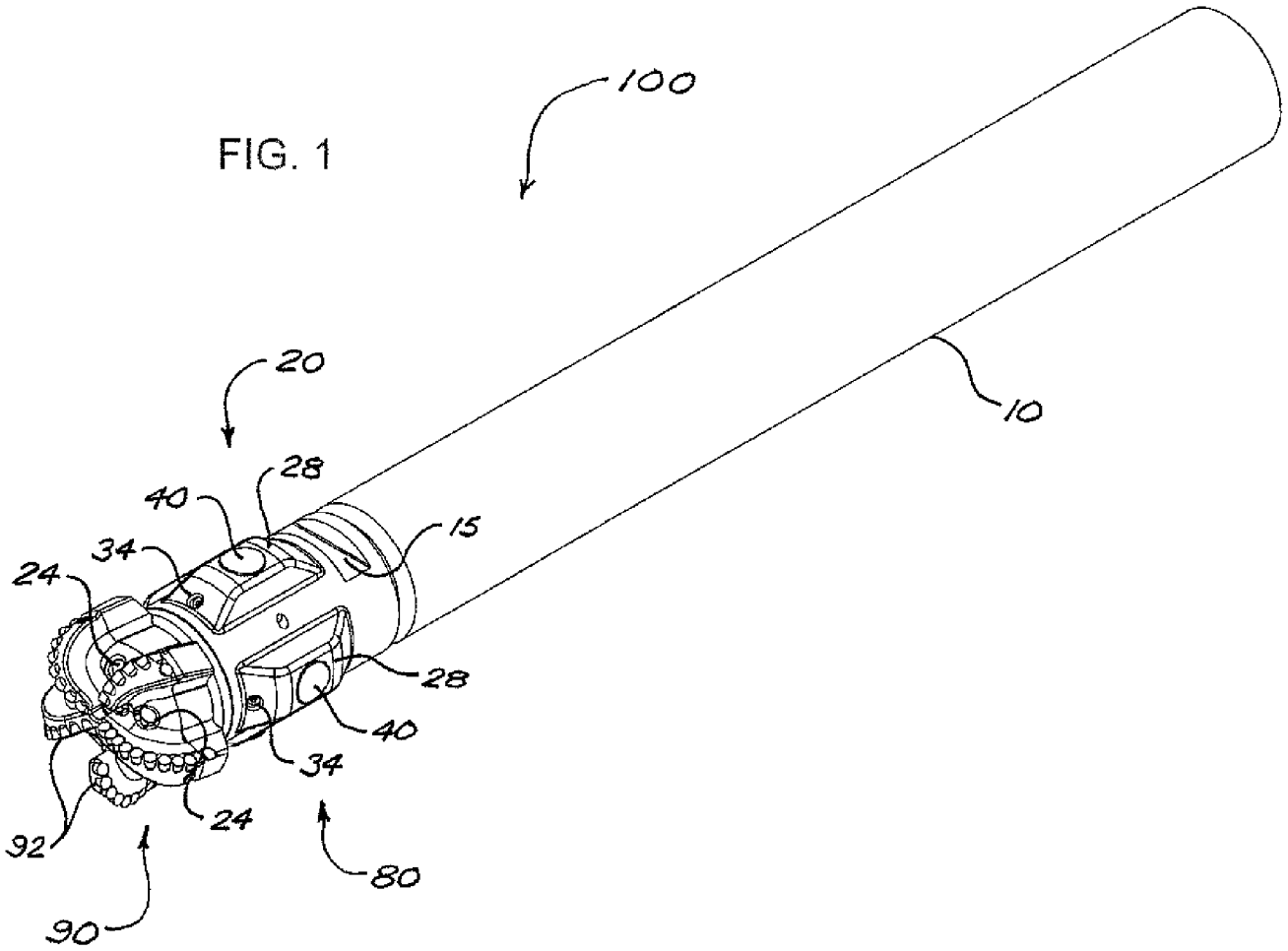
FIG. 1 is an isometric view of an embodiment of a rotary drilling apparatus in accordance with the principles described herein, with bit-deflecting pistons adapted for direct contact with the wall of a wellbore.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." A reference to an element by the indefinite article "a" does not exclude the possibility that more than one such element is present, unless the context clearly requires that there be one and only one such element. Any use of any form of the terms "connect", "engage", "couple", "attach", or other terms describing an interaction between elements is not intended to limit such interaction to direct interaction between the subject elements, and may also include indirect interaction between the elements such as through secondary or intermediary structure. Relational terms such as "parallel", "perpendicular", "coincident", "intersecting", "equal", "coaxial", and "equidistant" are not intended to denote or require absolute mathematical or geometrical precision. Accordingly, such terms are to be understood as denoting or requiring substantial precision only (e.g., "substantially parallel") unless the context clearly requires otherwise.

As used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Certain components of disclosed RSS tool embodiments are described herein using adjectives such as "upper" and "lower". Such terms are used to establish a convenient frame of reference to facilitate explanation and enhance the reader's understanding of spatial relationships and relative locations of the various elements and features of the components in question. The use of such terms is not to be interpreted as implying that they will be technically applicable in all practical applications and usages of RSS tools in accordance with the present disclosure, or that such sub tools must be used in spatial orientations that are strictly consistent with the adjectives noted above. For example, RSS tools in accordance with the present disclosure may be used in drilling horizontal or angularly-oriented wellbores. For greater certainty, therefore, the adjectives "upper" and "lower", when used with reference to an RSS tool, should be understood in the sense of "toward the upper (or lower) end of the drill string", regardless of what the actual spatial orientation of the RSS tool and the drill string might be in a given practical usage.

Figure 2:
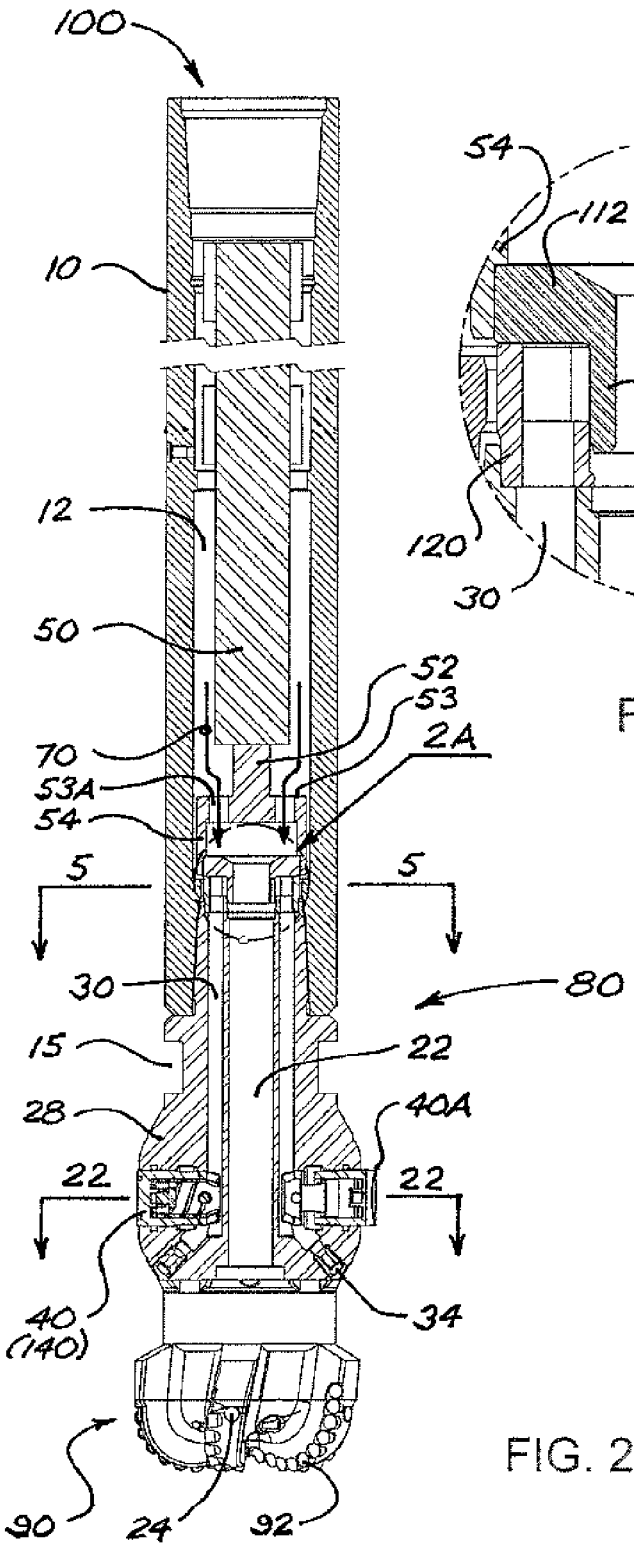
FIG. 2 is a longitudinal cross-section through a first variant of the rotary drilling apparatus in FIG. 1, in which the fluid-metering assembly comprises a rotating upper sleeve and a fixed lower sleeve.

FIGS. 1 and 2 illustrate (in isometric and cross-sectional views, respectively) a rotary steerable drilling apparatus (or "RSS tool") 100 in accordance with a first embodiment. RSS tool 100 includes a cylindrical outer housing 10 enclosing a control assembly 50 and a drill bit 20. An annular space 12 is radially disposed between control assembly 50 and housing 10, such that drilling fluid flowing into housing 10 will flow downward through annular space 12 toward drill bit 20. Drill bit 20 includes a steering section 80 connected to the lower end of housing 10, and a cutting structure 90 connected to the lower end of steering section 80 so as to be rotatable therewith. Steering section 80 is preferably formed or provided with means for facilitating removal from housing 10, such as bit breaker slots 15. In general, cutting structure 90 can be any suitable type of cutting structure (for example, a polycrystalline diamond compact bit or a roller-cone-style bit).

Steering section 80 has one or more fluid channels 30 extending downward from the upper end of steering section 80. As seen in FIG. 2, steering section 80 also has a central axial channel 22 for conveying drilling fluid to cutting structure 90, where the drilling fluid can exit under pressure through jets 24 in the face of cutting structure 90 to enhance the effectiveness of cutting structure 90 as it drills into subsurface formation. Each fluid channel 30 leads to the radially inner end of a corresponding piston 40 extendable radially outward from steering section 80 in response to pressure from an actuating fluid flowing under pressure through fluid channel 30. In this embodiment, each fluid channel 30 extends axially beyond its corresponding piston 40 to a terminal bit jet 34, which allows for fluid drainage and for bleeding off of fluid pressure.

Steering section 80 defines and incorporates a plurality of piston housings 28 protruding radially outward from steering section 80 (the main body of which will typically have a diameter matching or close to that of housing 10). The radial travel of each piston 40 is preferably restricted by any suitable means (indicated by way of example in FIG. 12 in the form of a transverse pin 41 passing through a slotted opening 43 in piston 40 and secured within piston housing 28 on each side of piston 40). This particular feature is by way of example only, and persons skilled in the art will appreciate that other means for restricting piston travel may be readily devised without departing from the scope of the present disclosure. Pistons 40 are also preferably provided with suitable biasing means (such as, by way of non-limiting example, biasing springs) biasing pistons 40 radially inward toward a refracted position within their respective piston housings 28.

In this embodiment, the piston-actuating fluid is a portion of the drilling fluid diverted from the fluid flowing through axial channel 22 to cutting structure 90. However, in other embodiments, the piston-actuating fluid could alternatively be a fluid different from and/or from a different source than the drilling fluid flowing to cutting structure 90.

RSS tool 100 includes a fluid-metering assembly which, in the embodiment shown in FIG. 2, comprises an upper sleeve 110 which is rotatable by means of control assembly 50 within and relative to a lower sleeve 120, which in turn is fixed to or integral with the upper end of steering section 80. As best seen in FIGS. 2A, 3A, 3B, and 3C, rotatable upper sleeve 110 has a bore 114 extending axially through a cylindrical section 116 extending axially downward from an annular upper flange 112. Cylindrical section 116 has a fluid-metering opening shown in the form of a vertical slot 118. As seen in FIGS. 2A, 4A, 4B, and 4C, fixed lower sleeve 120 has a bore 121 and a number of fluid inlets 122 geometrically arranged to correspond with the fluid channels 30 in steering section 80. In the illustrated embodiments, fluid inlets 122 are circumferentially spaced and arranged in a circular pattern centered about the longitudinal centerline $CL_{RSS}$ of RSS tool 100.

Figure 2A:
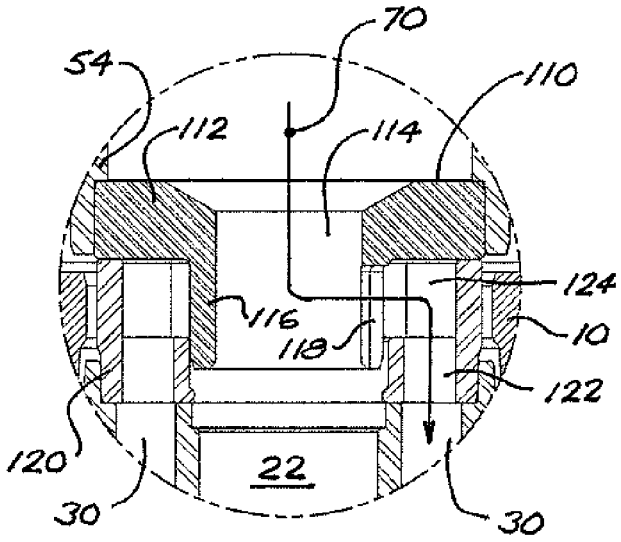
FIG. 2A is an enlarged detail of the fluid-metering assembly in FIG. 2.
Figure 3A:
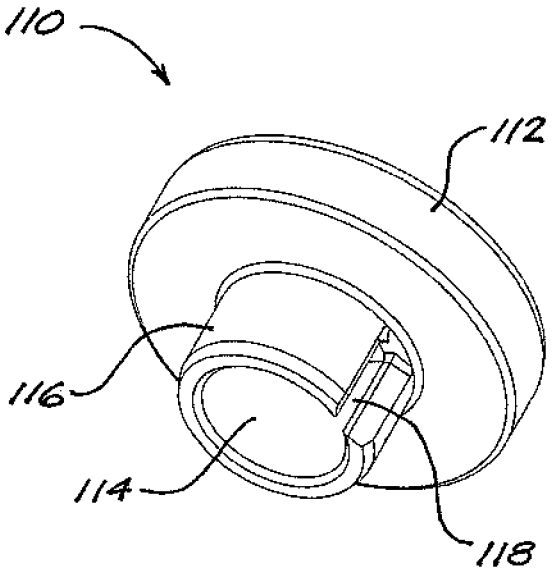
FIGS. 3A, 3B, and 3C are isometric, cross-sectional, and side views, respectively, of the rotating upper sleeve of the rotary drilling apparatus in FIG. 2.
Figure 3B:
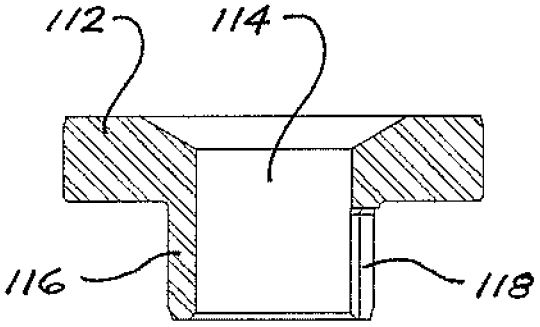
Figure 3C:
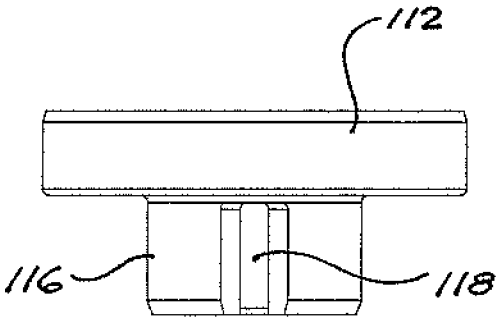
Figure 4A:
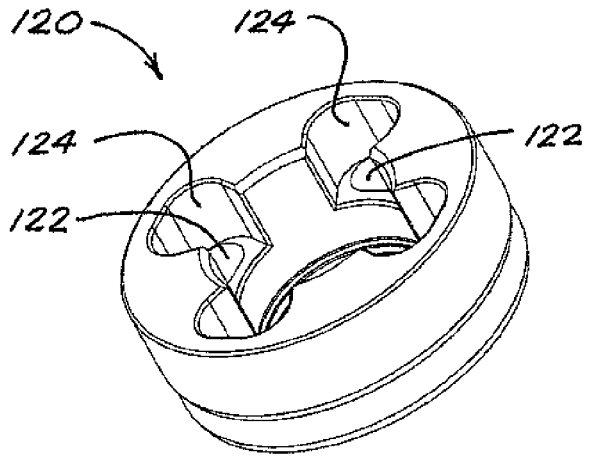
FIGS. 4A, 4B, and 4C are isometric, cross-sectional, and side views, respectively, of the fixed lower sleeve of the rotary drilling apparatus in FIG. 2.
Figure 4B:
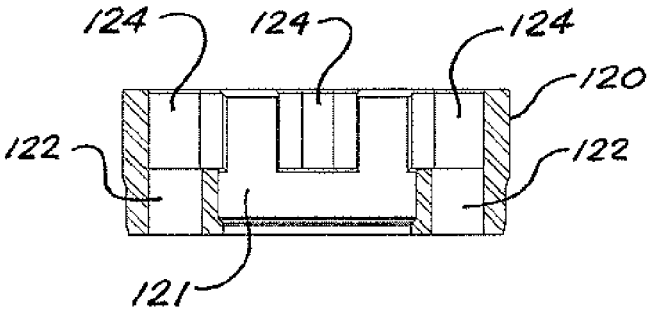
Figure 4C:
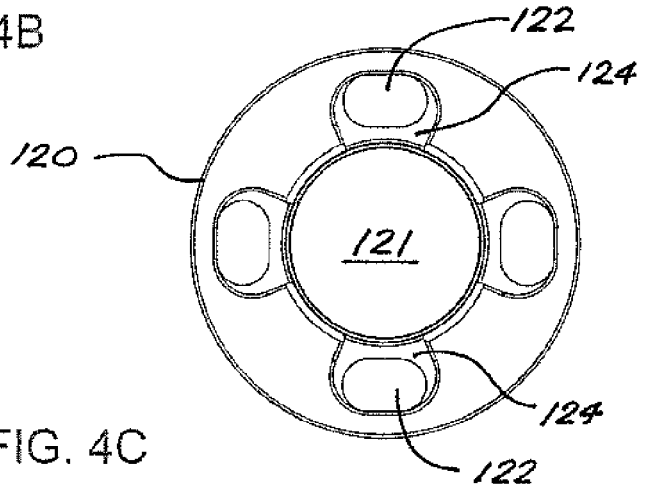
Figure 5:
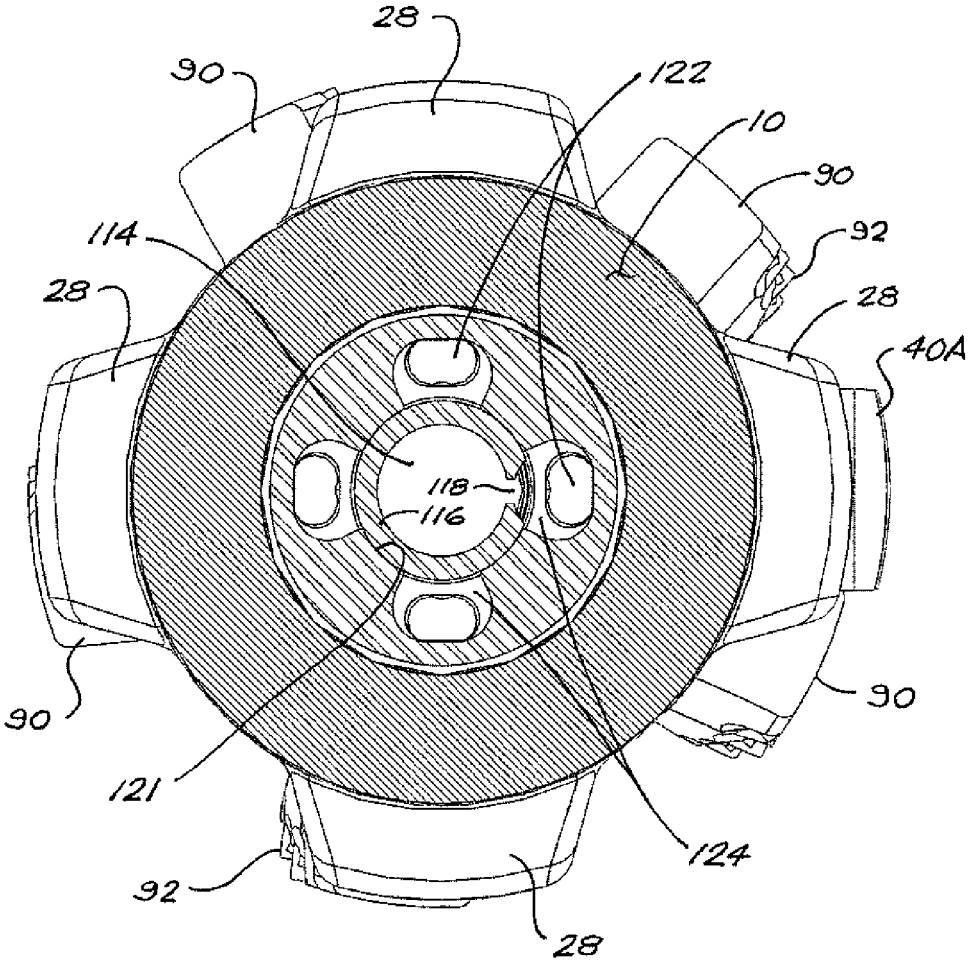
FIG. 5 is a transverse cross-section through the rotary drilling apparatus in FIG. 2, showing the fluid-metering slot in the rotating upper sleeve aligned with a fluid inlet in the fixed lower sleeve to permit fluid flow into the corresponding fluid channel in the drill bit, and showing the corresponding piston extended.
Figure 6:
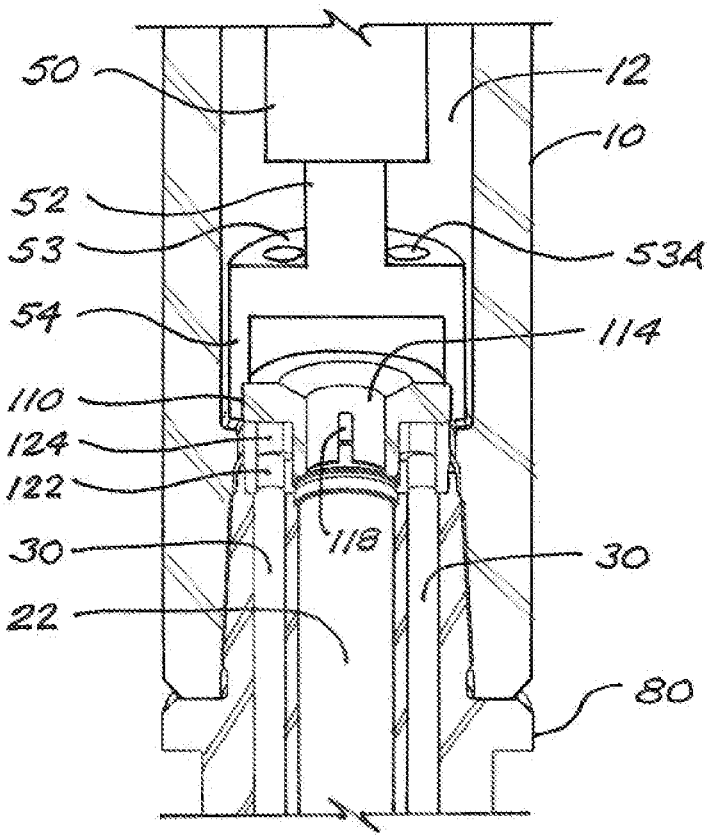
FIG. 6 is an isometric partial longitudinal section through a medial region of the rotary drilling apparatus in FIG. 2, showing the rotating upper sleeve, fixed lower sleeve with fluid inlets, and fluid channels in the steering section.

Recesses 124 are formed in an upper region of lower sleeve 120 to provide fluid communication between each fluid inlet 122 and bore 121. Accordingly, as best shown in FIGS. 2A and 6, when cylindrical section 116 of upper sleeve 110 is disposed within bore 121 of lower sleeve 120, with fluid-metering slot 118 aligned with a given recess 124 in lower sleeve 120, bore 114 of upper sleeve 110 will be in fluid communication with the corresponding fluid channel 30 in steering section 80, via slot 118, recess 124, and fluid inlet 122. As may be seen in FIG. 5, the resultant flow of actuating fluid under pressure within the corresponding fluid channel 30 results in actuation and radially-outward extension of the corresponding piston (indicated in FIG. 5 by reference numeral 40A to denote an actuated piston).

The assembly and operation of the fluid-metering assembly described above can be further understood with reference to FIG. 6. Control assembly 50 is provided with metering assembly engagement means for rotating upper sleeve 110, and this could take any functionally effective form. By way of non-limiting example, in this embodiment, the metering assembly engagement means is shown in FIGS. 2, 2A, and 6 as comprising a shaft 52 operably connected at its upper end to control assembly 50, and connected at its lower end to a cylindrical yoke 54 having an upper end plate 53 with one or more fluid openings 53A. Cylindrical yoke 54 is concentrically connected at its lower end 54L to flange 112 of upper sleeve 110, such that upper sleeve 110 will rotate relative to lower sleeve 120 when shaft 52 is rotated by control assembly 50. A fluid 70 flowing downward within the annular space 12 surrounding control assembly 50 within housing 10 flows through fluid openings 53A in upper end plate 53 of yoke 54, into the cylindrical cavity 55 within yoke 54, and then into bore 114 of upper sleeve 110. A portion of fluid 70 is diverted through slot 118 in cylindrical section 116 of upper sleeve 110 into the fluid inlet 120 aligned at the time with slot 118, and then into the corresponding fluid channel 30 to actuate the corresponding piston 40. The remainder of fluid 70 flows into main axial channel 22 in steering section 80 for delivery to cutting structure 90.

Figure 7:
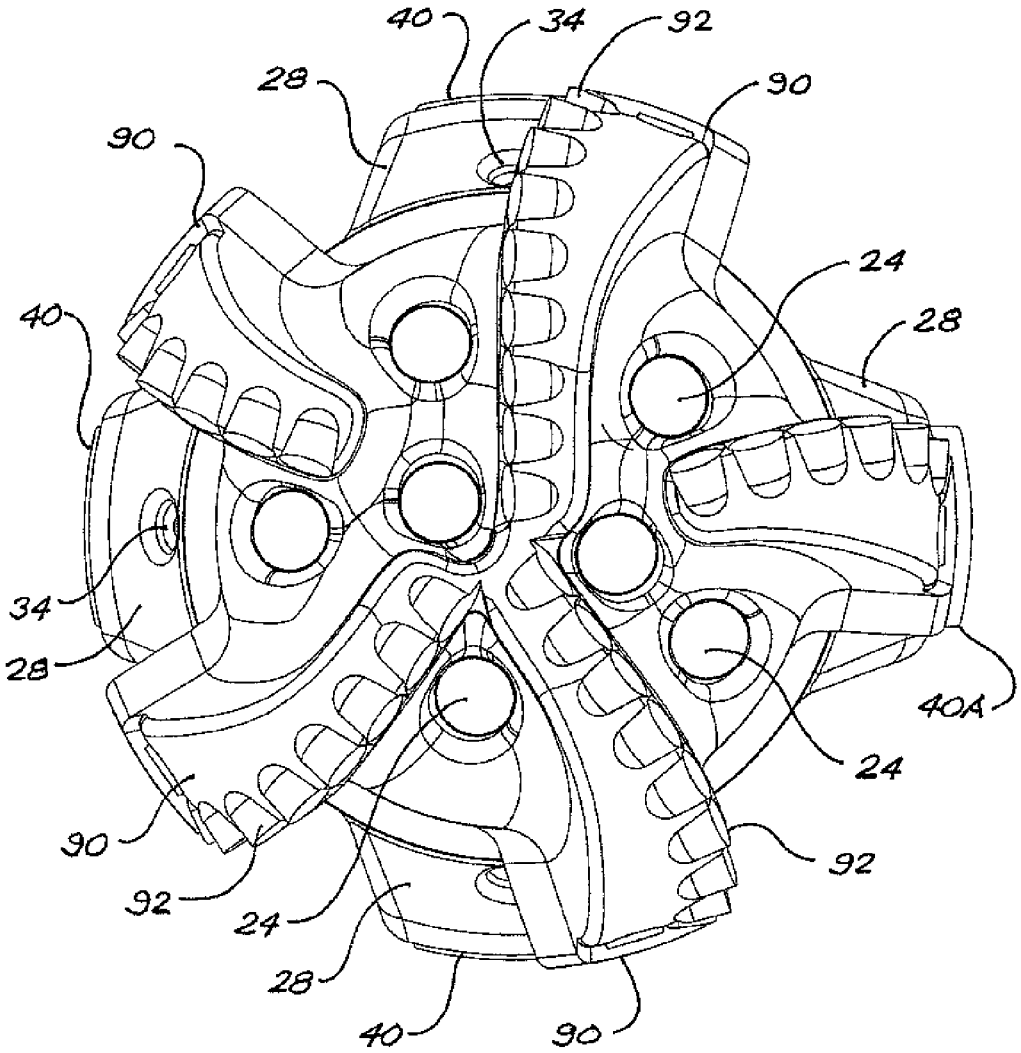
FIG. 7 is a bottom view of the rotary drilling apparatus of FIG. 2, showing the drill bit and piston housings, with one bit-deflecting piston extended.
Figure 13:
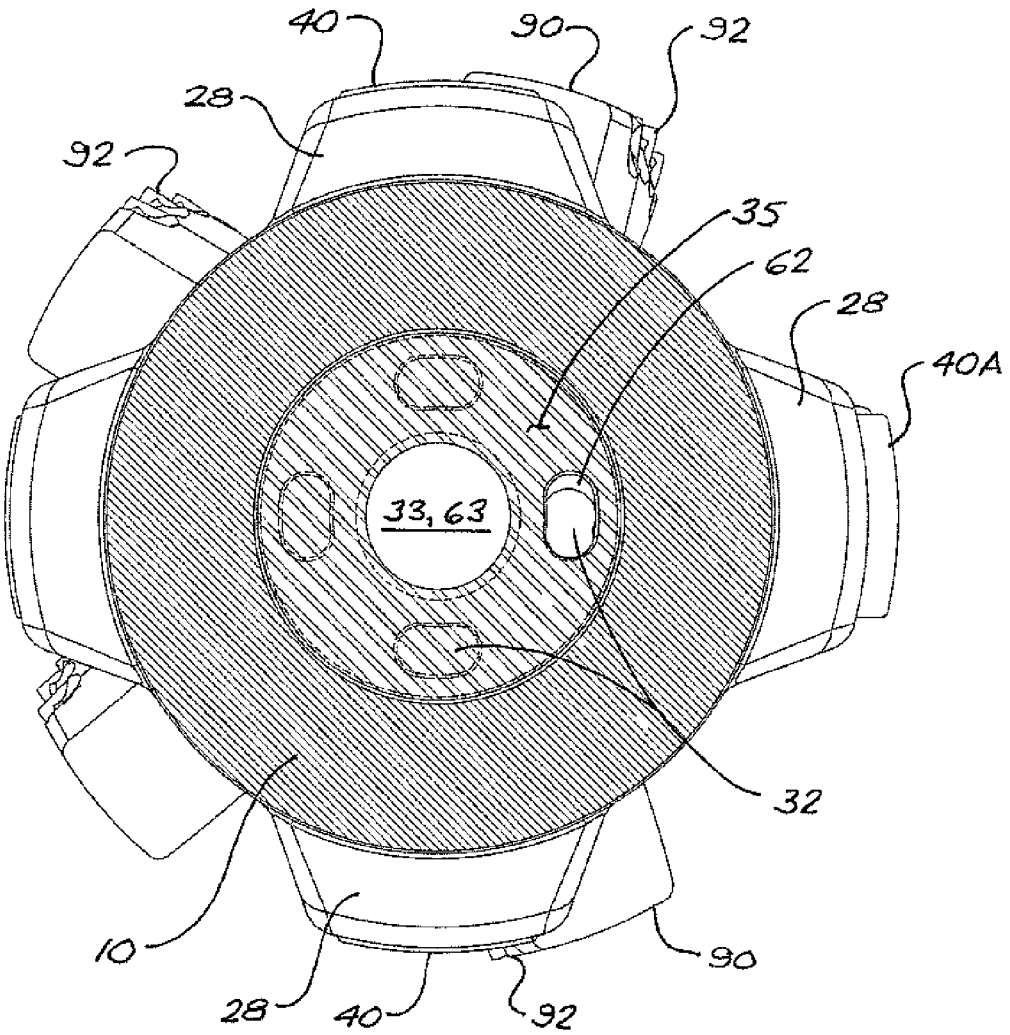
FIG. 13 is a transverse cross-section through the rotary drilling apparatus in FIG. 12, illustrating the fluid-metering opening in the rotating upper plate aligned with a fluid inlet through the fixed upper plate into the drill bit, and showing the corresponding bit-deflecting piston extended.

FIG. 7 is a bottom view of drill bit 20, showing cutting structure 90 with cutting elements or teeth 92, bit jets 24, pistons 40, and piston housings 28. In FIG. 13, one piston, marked 40A, is shown in its actuated position, extending radially outward from its piston housing 28.

Figure 8B:
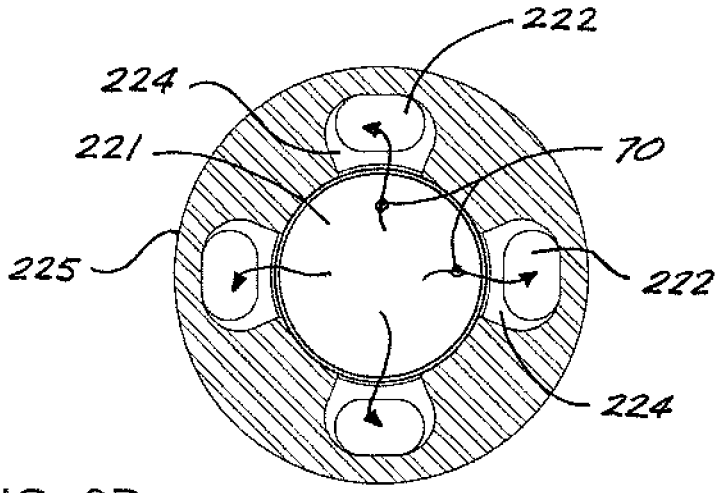
FIG. 8B is a transverse cross-section through the sleeve assembly in FIG. 8A, illustrating flow of piston-actuating fluid into all fluid inlets.
Figure 8A:
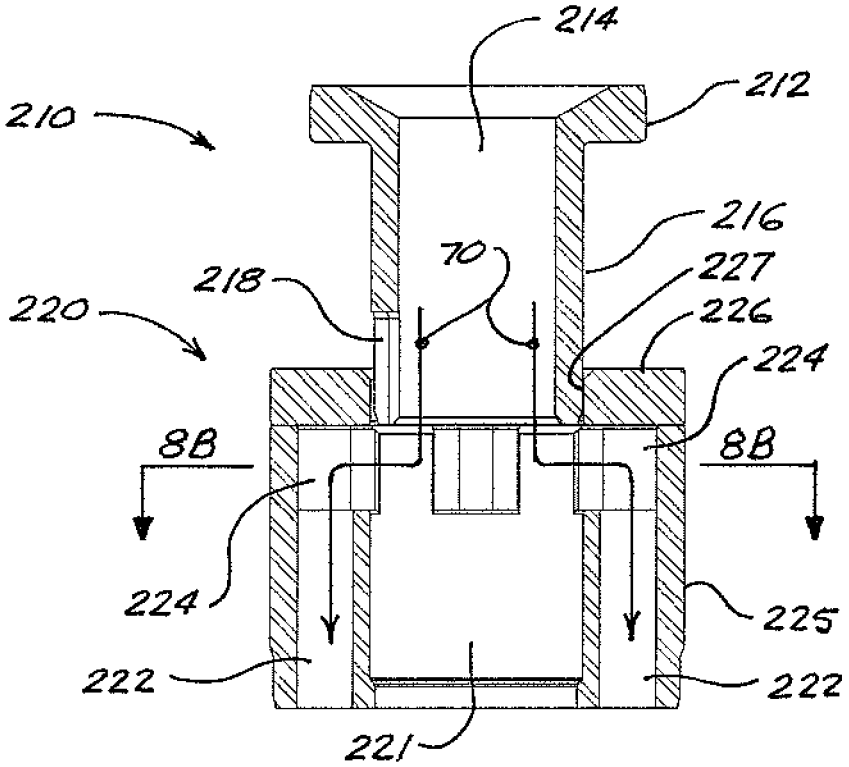
FIG. 8A is a cross-section through a variant of the sleeve assembly shown in FIGS. 2-6, with the rotating upper sleeve in an upper position in which piston-actuating fluid flows into all fluid channels.

FIG. 8A illustrates a variant of the sleeve assembly shown in FIGS. 2 and 6 and related detail drawings. Upper sleeve 210 in FIG. 8A is generally similar to upper sleeve 110 in FIGS. 3A-3C, with a flange 212 and a bore 214 similar to flange 112 and bore 114 in upper sleeve 110, except that it has a cylindrical section 216 longer than cylindrical section 116 in upper sleeve 110. Cylindrical section 216 has a fluid-metering slot 218 similar to fluid-metering slot 118 in cylindrical section 116, located in a lower region of cylindrical section 216. Lower sleeve 220 in FIG. 8A is generally similar to lower sleeve 120 in FIGS. 4A-4C, with fluid inlets 222 below corresponding recesses 224 (similar to fluid inlets 122 and recesses 24 in lower sleeve 120) formed into a lower body 225 having a bore 221 analogous to bore 121 in lower sleeve 120, plus a cap plate 226 extending across the top of lower body 25 and having a central opening for receiving cylindrical section 216 of upper sleeve 210.

As best shown in FIGS. 8A and 8B, when upper sleeve 210 is in an upper position relative to lower sleeve 220, with cylindrical section 216 raised at least partially clear of recesses 224 in lower sleeve 220, portions of fluid 70 flowing into bore 214 in upper sleeve 210 and bore 221 in lower sleeve 220 will be diverted directly into all recesses 224 and fluid inlets 222 to actuate all of pistons 40. In this operational mode, the actuated pistons serve to centralize and stabilize drill bit 20 when drilling an undeviated section of a wellbore. This may be particularly beneficial and advantageous when drilling a straight but non-vertical section of the wellbore, and/or when it is desirable to maximize the total flow area (TFA) at the bit (TFA being defined as the total area of all nozzles or jets through which fluid can flow out of the bit). TFA will be greatest when upper sleeve 210 is in its uppermost position, in which fluid can flow into all fluid channels 30. This is because fluid will be able to flow out of all terminal bit jets 34 connecting to fluid channels 30, in addition to flowing out of all bit jets 24 in cutting structure 90. In contrast, TFA will be least when upper sleeve 210 is in its lowermost position (as shown in FIGS. 10A and 10B), in which fluid flow into all fluid channels 30 is blocked, and fluid can exit the tool only through bit jets 24.

Drill bit stabilization with all pistons radially extended may also be desirable during "straight" drilling to mitigate "bit whirl," which can result in poor wellbore quality when drilling through soft formations.

Figure 9B:
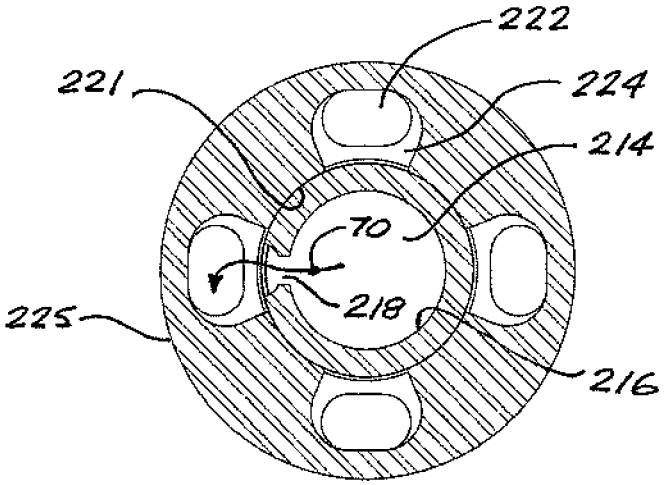
FIG. 9B is a transverse cross-section through the sleeve assembly in FIG. 9A, illustrating flow of piston-actuating fluid into the fluid inlet aligned with the slot in the rotating upper sleeve.
Figure 9A:
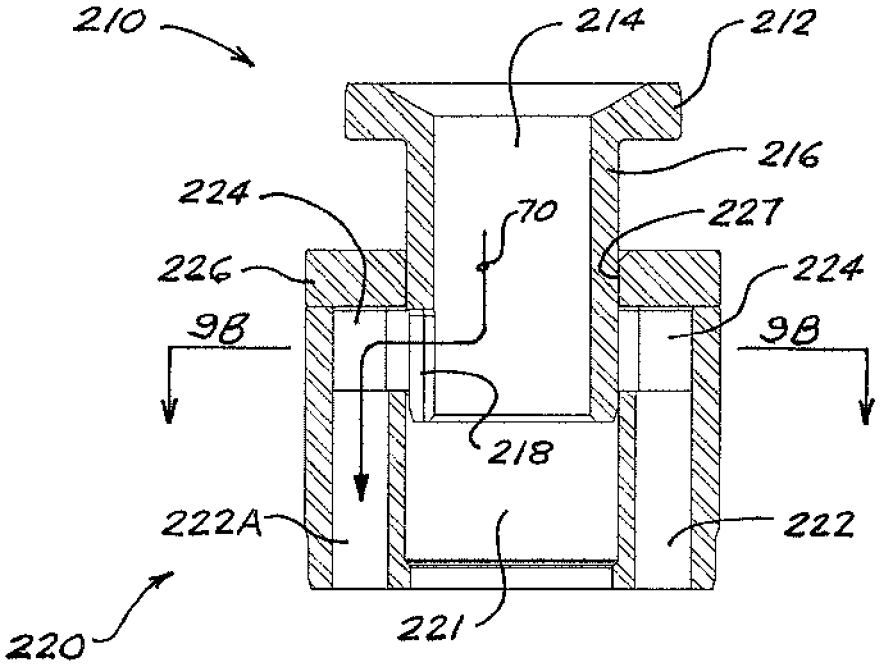
FIG. 9A is a cross-section through the variant sleeve assembly in FIG. 8A, with the rotating upper sleeve in an intermediate position in which piston-actuating fluid flows only into one fluid inlet.

FIGS. 9A and 9B illustrate the situation when upper sleeve 210 is in an intermediate position relative to lower sleeve 220, with cylindrical section 216 extending axially below cap plate 226 to permit fluid flow from bore 214 through fluid-metering slot 218. In this operational mode, fluid 70 is diverted into a recess 224 aligned with slot 218, and then into the corresponding fluid inlet 222 to actuate the corresponding piston 40; i.e., essentially the same as for the sleeve assembly shown in FIG. 2A.

Figure 10B:
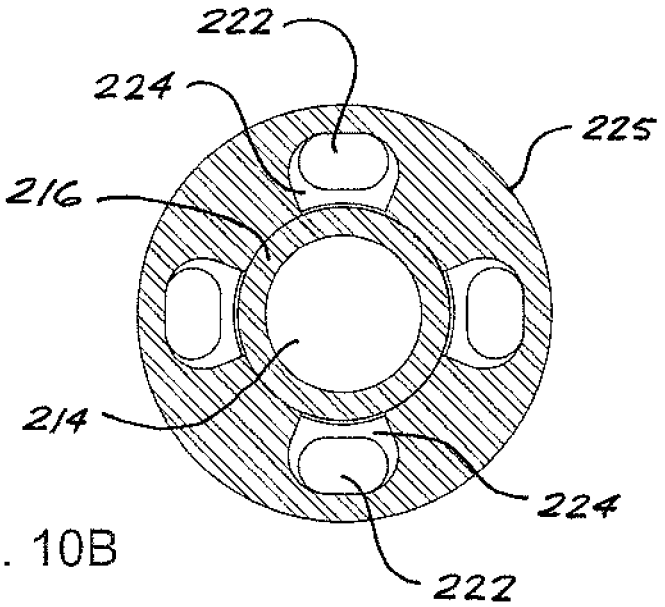
FIG. 10B is a transverse cross-section through the sleeve assembly in FIG. 10A, illustrating fluid flow to the fluid inlets blocked.
Figure 10A:
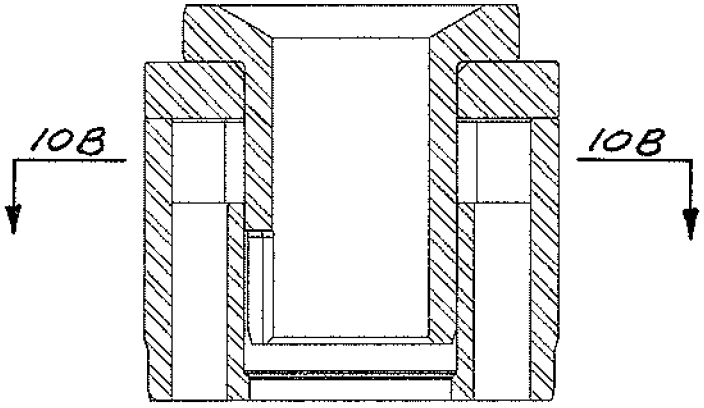
FIG. 10A is a cross-section through the variant sleeve assembly in FIG. 8A, with the rotating upper sleeve in a lower position in which actuating fluid cannot flow into any of the fluid inlets.

FIGS. 10A and 10B illustrate the situation when upper sleeve 210 is in a lower position relative to lower sleeve 220, with slot 218 disposed axially below recesses 224 such that fluid cannot enter any of recesses 224 and fluid inlets 222. In this operational mode, all of fluid 70 flows directly to cutting structure 90, without diversion. This may be desirable for straight drilling through comparatively stable subsoil materials, with a smaller TFA at the bit.

To operate a fluid-metering assembly incorporating upper and lower sleeves 210 and 220 as in FIGS. 8A-10B, control assembly 50 incorporates or is provided with means for raising and lowering upper sleeve 210 in addition to rotating upper sleeve 210. In general, any suitable means known in the art (e.g., a motor) can be employed to axially move upper sleeve 210 relative to lower sleeve 220.

Figure 11:
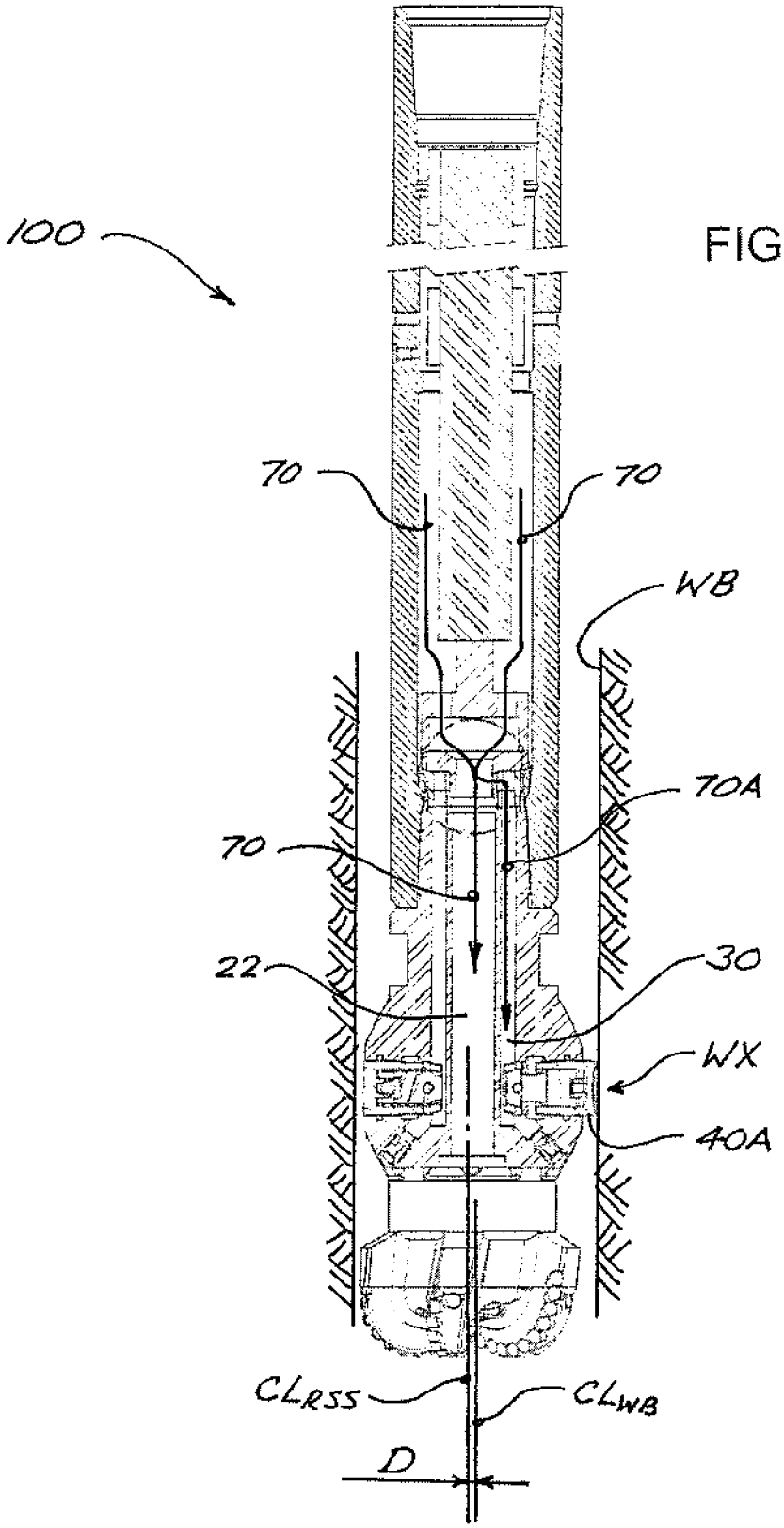
FIG. 11 is a longitudinal cross-section similar to FIG. 2, showing the rotary drilling apparatus in operation within a wellbore, with one piston radially extended and exerting a bit-deflecting force against one side of the wellbore.

FIG. 11 illustrates RSS tool 100 as in FIG. 2, in operation within a wellbore WB. In this view, a portion 70A of fluid 70 from annular space 12 of RSS 100 is diverted into an "active" fluid channel 30A in steering section 80 via fluid-metering slot 118 in rotating upper sleeve 110 of the fluid-metering assembly. The flow of fluid under pressure into fluid channel 30A actuates the corresponding piston 40A, causing actuated piston 40A to extend radially outward from steering section 80 and into reacting contact with the wall of wellbore WB in a contact region WX, thus exerting a transverse force against steering section 80 deflecting cutting structure 90 in the direction away from contact region WX by a deflection D, being the lateral offset of the deflected axial centerline $CL_{RSS}$ of RSS tool 100 relative to the centerline $CL_{WB}$ of wellbore WB. Contact region WX, for a given fixed orientation of upper sleeve 110 and its fluid-metering slot 118 relative to wellbore WB, will not be a specific fixed point or region on the wellbore wall, but rather will move as drilling progresses deeper into the ground. However, in operational modes providing for actuation of only one piston 40 at a given time, contact region WX corresponds to the angular position of fluid-metering slot 118.

As tool 100 continues rotating, the flow of actuating fluid 70A into active fluid channel 30A is blocked off, thus relieving the hydraulic force actuating piston 40A which is then refracted into the body of steering section 80. Further rotation of tool 100 causees actuating fluid to flow into the next fluid channel 30 in steering section 80, thereby actuating and extending the next piston 40 in sequence, and exerting another transverse force in contact region WX of wellbore WB.

Accordingly, for each rotation of tool 100, a bit-deflecting transverse force will be exerted against wellbore WB, in contact region WX, the same number of times as the number of fluid channels 30 in steering section 80, thus maintaining an effectively constant deflection D of cutting structure 90 in a constant transverse direction relative to wellbore WB. As a result of this deflection, the angular orientation of wellbore WB will gradually change, creating a curved section in wellbore WB.

When a desired degree of wellbore curvature or deviation has been achieved, and it is desired to drill an undeviated section of wellbore, the operation of control assembly 50 is adjusted to rotate upper sleeve 110 such that fluid-metering slot 118 is in a neutral position between an adjacent pair of recesses 124 in lower sleeve 120, such that fluid 70 cannot be diverted into any of the fluid inlets 122 in lower sleeve 120. Control assembly 50 (or an associated metering assembly engagement means) then is either disengaged from upper sleeve 110, leaving upper sleeve 110 free to rotate with lower sleeve 120 and steering section 80, or alternatively is actuated to rotate at the same rate as tool 100, thereby in either case maintaining slot 118 in a neutral position relative to lower sleeve 120 such that fluid cannot flow to any of pistons 40. Drilling operations can then be continued without any transverse force acting to deflect cutting structure 90.

In other embodiments in which the fluid-metering assembly includes axially-movable upper sleeve 210 and lower sleeve 220 as shown in FIGS. 8A-10B, the transition to non-deviated drilling operations is effected by moving upper sleeve 210 (by means of control assembly 50) to either its upper or lower position relative to lower sleeve 220, as may be desired or appropriate having regard to operational considerations. Fluid flow to fluid channels 30 will then be prevented regardless of whether upper sleeve 210 continues to rotate relative to lower sleeve 220.

Figure 12:
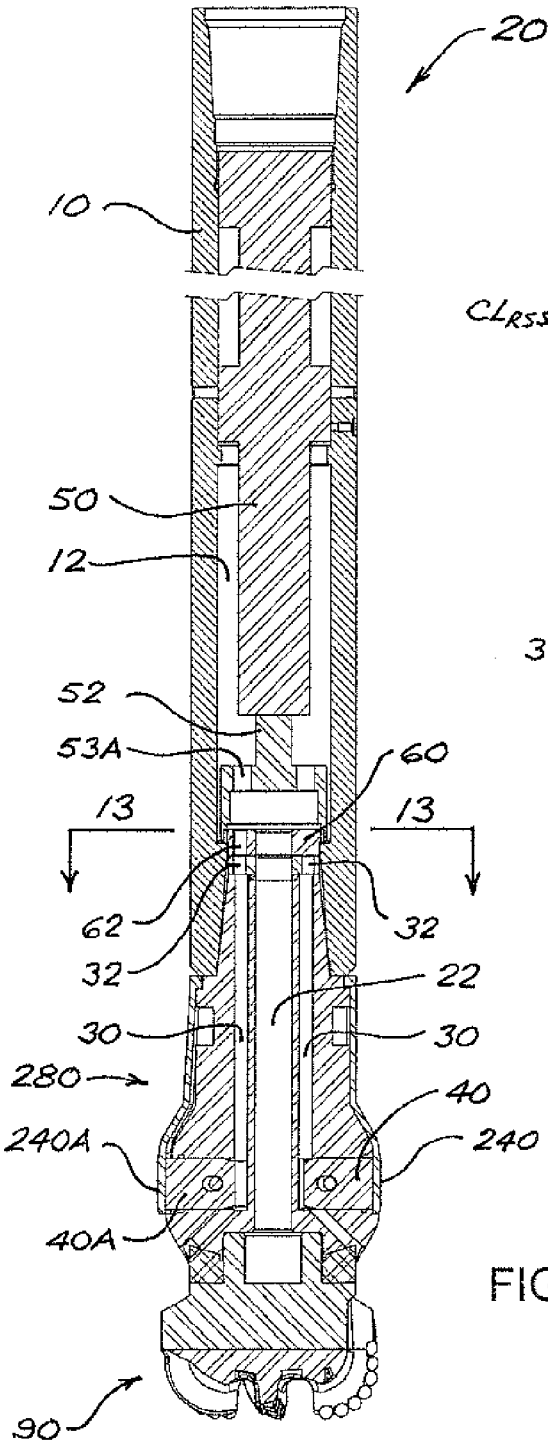
FIG. 12 is a longitudinal cross-section through a second variant of the rotary drilling apparatus in FIG. 1 in accordance with the principles described herein, with a resiliently-mounted reaction member associated with each piston, and in which the fluid-metering assembly comprises a rotating upper plate and a fixed lower plate.
Figure 12A:
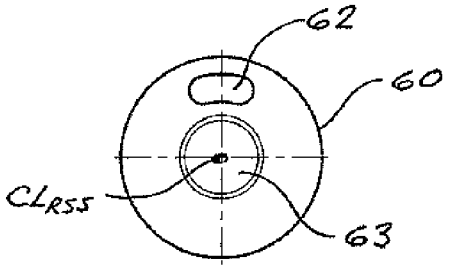
FIG. 12A is a plan view of the rotating upper plate of the fluid-metering assembly in FIG. 12.
Figure 12B:
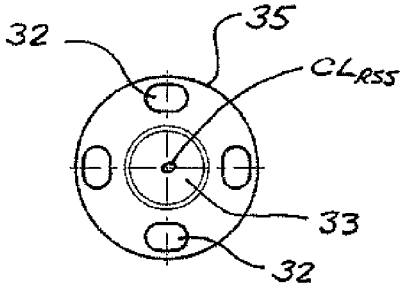
FIG. 12B is a plan view of the fixed lower plate of the fluid-metering assembly in FIG. 12.

FIG. 12 illustrates an RSS tool 200 in accordance with an alternative embodiment in which the fluid-metering assembly comprises a rotating upper plate 60 and a lower plate 35 fixed to or formed integrally into the upper end of a modified steering section 280. Lower plate 35 has one or more fluid inlets 32 analogous to fluid inlets 122 in lower sleeve 120 shown in FIGS. 2 and 6 (and elsewhere herein). As shown in FIG. 12B, fluid inlets 32 are circumferentially spaced and arranged in a circular pattern about centerline $CL_{RSS}$ of RSS tool 200. Upper plate 60 is rotatable, relative to housing 10, about a rotational axis coincident with centerline $CL_{RSS}$. As shown in FIG. 12A, upper plate 60 has a fluid-metering hole 62 offset from centerline $CL_{RSS}$ at a radius corresponding to the radius of the circle of the fluid inlets 32 formed in fixed lower plate 35. Upper plate 60 also has a central opening 63 to permit fluid flow downward into axial channel 22 of steering section 80, and lower plate 35 has a central opening 33 for the same purpose.

The fluid-metering assembly shown in FIGS. 12, 12A, and 12B functions in essentially the same way as previously described with respect to RSS tool embodiments having a fluid-metering assembly incorporating an upper sleeve 110 (or 210) and a lower sleeve 120 (or 220). Upper plate 60 is rotated by control assembly 50 (such as by means of a yoke 54 as previously described) so as to keep fluid-metering hole 62 in a fixed orientation relative to wellbore WB irrespective of the rotation of housing 10 and steering section 80. As housing 10 and steering section 80 rotate relative to wellbore WB, fluid-metering hole 62 in upper plate 60 come into alignment with each of the fluid inlets 32 in lower plate 35 in sequence, thus allowing a portion of the fluid flowing from annular space 12 through fluid openings 53A in upper end plate 53 of yoke 54 to be diverted into each fluid channel 30 in sequence, and causing the corresponding pistons 40 to be radially extended in sequence, thus inducing a deviation in the orientation of wellbore WB as previously described.

FIG. 13 is a cross-section through housing 10 just above rotating upper plate 60, showing offset hole 62 in upper plate 60 and, in broken outline, fluid inlets 32 (four in total in the illustrated embodiment) in fixed lower plate 35 disposed below upper plate 60. As well, FIG. 13 illustrates pistons 40 and their corresponding piston housings 28 (four in total, corresponding to the number of fluid inlets 32) and, therebelow, cutting structure 90 with drill bit teeth 92. FIG. 13 illustrates the alignment of fluid-metering hole 62 of upper plate 60 with one of the fluid inlets 32 in lower plate 35, resulting in radially-outward extension of a corresponding actuated piston 40A.

To transition RSS tool 200 to undeviated drilling operations, control assembly 50 is actuated to rotate upper plate 60 to a neutral position relative to lower plate such that fluid-metering hole 62 is not in alignment with any of the fluid inlets 32 in lower plate 35, and upper plate 60 is then rotated at the same rate as steering section 80 to keep fluid-metering hole 62 in the neutral position relative to lower plate 35.

In an alternative embodiment of the apparatus (not shown), upper plate 60 can be selectively moved axially and upward away from lower plate 35, thus allowing fluid flow into all fluid channels 30 and causing outward extension of all pistons 40. This results in equal transverse forces being exerted all around the perimeter of steering section 80 and effectively causing cutting structure 90 to drill straight, without deviation, while also stabilizing cutting structure 90 within wellbore WB, similar to the case for previously-described embodiments incorporating upper and lower sleeves 210 and 220 when upper sleeve 210 is in its upper position relative to lower sleeve 220. Control system 50 can be deactivated or put into hibernation mode when upper plate 60 and lower plate 35 are not in contact, thus saving battery life and wear on the control system components.

In one embodiment, control assembly 50 comprises an electronically-controlled positive displacement (PD) motor that rotates upper plate 60 (or upper sleeve 110 or 210), but control assembly 50 is not limited to this or any other particular type of mechanism.

Embodiments of steerable rotary drilling systems in accordance with the principles described herein can be readily adapted to facilitate change-out of the highly-cycled pistons during bit changes. This ability to change out the pistons independently of the control system, in a design that provides a field-changeable interface, makes the system more compact, easier to service, more versatile, and more reliable than conventional steerable systems. In addition, embodiments of RSS tools in accordance with the principles described herein also allow multiple different sizes and types of drill bits and/or pistons to be used in conjunction with the same control system without having to change out anything other than the steering system and/or cutting structure. This means, for example, that the system can be used to drill a 12¼" (311 mm) wellbore, and subsequently be used to drill a 8¾" (222 mm) wellbore, without changing the control system housing size, thus saving time and requiring less equipment.

The system can also be adapted to allow use of the drill bit separately from the control system. Optionally, the control assembly can be of modular design to control not only drill bits but also other drilling tools that can make beneficial use of the rotating upper plate (or sleeve) of the tool to perform useful tasks.

FIGS. 14A, 14B, 14C, and 14D illustrate the steering section 280 of an RSS tool in accordance with the embodiment shown in FIG. 12. Steering section 280 is substantially similar to steering section 80 described with reference to FIG. 12, and like reference numbers are used for components common to both embodiments. Steering section 280 is shown by way of non-limiting example with an upper pin end 16 for purposes of threaded connection to the lower end of housing 10, and with a lower box end 17 for threaded connection to the upper end of cutting structure 90. Steering section 280 is distinguished from steering section 80 shown in FIG. 2 by the provision of flexible reaction pads 240, each of which has an upper end resiliently mounted to the main body of steering section 280 and a free lower end 241 which extends over a corresponding piston housing 28. In the illustrated embodiment, the resilient mounting of flexible reaction pads 240 to the body of steering section 280 is accomplished by having the upper ends of reaction pads 240 formed integrally with a circular band 242 disposed within an annular groove 243 extending around the circumference of steering section 280 at a point below pin end 16. However, this is by way of example only. Persons skilled in the art will appreciate that other ways of resiliently mounting the upper ends of reaction pads 240 to steering section 280 may be readily devised, and the present disclosure is not limited to the use of any particular means or method of mounting reaction pads 240.

Figure 14C:
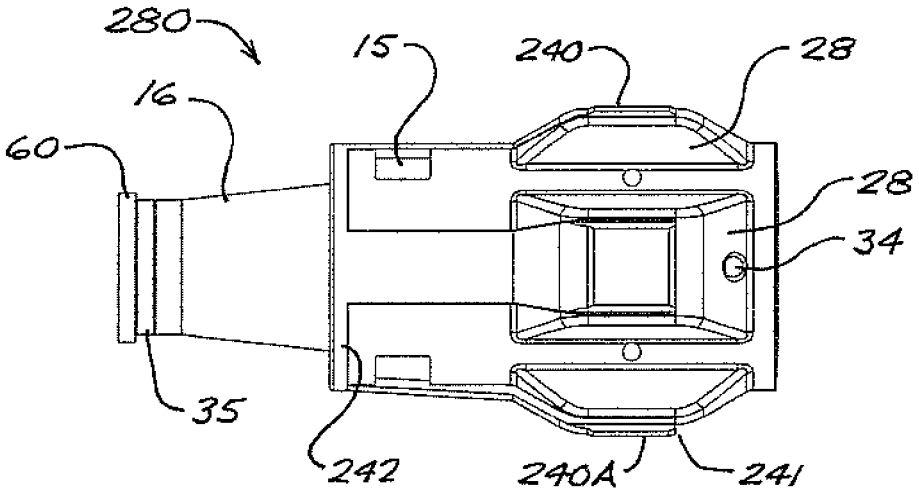
FIG. 14C is a side view of the apparatus in FIG. 14A, with one piston actuated and deflecting its associated flexible reaction member.
Figure 14D:
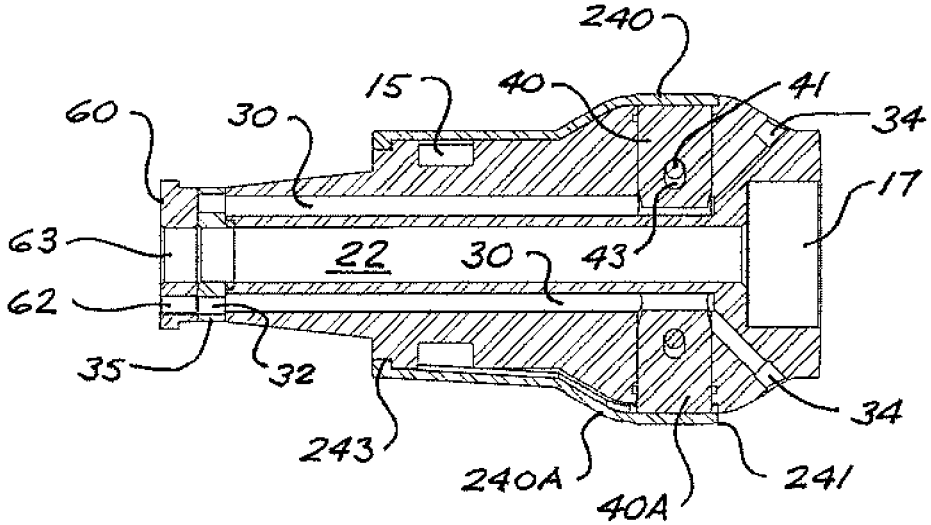
FIG. 14D is a longitudinal cross-section through the apparatus in FIG. 14A, with one piston actuated and deflecting its associated flexible reaction member.

As best appreciated with reference to the upper portion of FIG. 14D, when a given piston 40 is in its retracted position, the free lower end 241 of its associated flexible reaction pad 240 preferably lies flush or nearly so with the outer surface of the associated piston housing 28. However, when a piston is actuated (as illustrated by actuated piston 40A in the lower portion of FIG. 14D), it deflects the free lower end 241 of the associated reaction pad (indicated by reference number 240A in FIG. 14D) radially outward. The deflected flexible reaction pad 240A is thus be pushed radially toward and against the wall of the wellbore, resulting in steering section 280 and cutting structure 90 being pushed in the radially opposite direction. When actuated piston 40A retracts into its piston housing 28, the free lower end of reaction pad 240A elastically rebounds to its unstressed state and position.

FIGS. 15A, 15B, 15C, and 15D illustrate the steering section 380 of an RSS tool in accordance with an alternative embodiment. Steering section 380 is substantially similar to steering section 80 described with reference to FIG. 12, and like reference numbers are used for components common to both embodiments. Steering section 380 is distinguished from steering section 80 by the provision of hinged reaction pads 340, each of which extends over a corresponding piston housing 28, to which reaction pad 340 is mounted at one or more hinge points 342 so as to be pivotable about a hinge axis substantially parallel to the longitudinal axis of steering section 380. Hinge points 342 are preferably located on the leading edges of hinged reaction pads 340 (the term "leading edge" being relative to the direction of rotation of the tool).

Figure 15A:
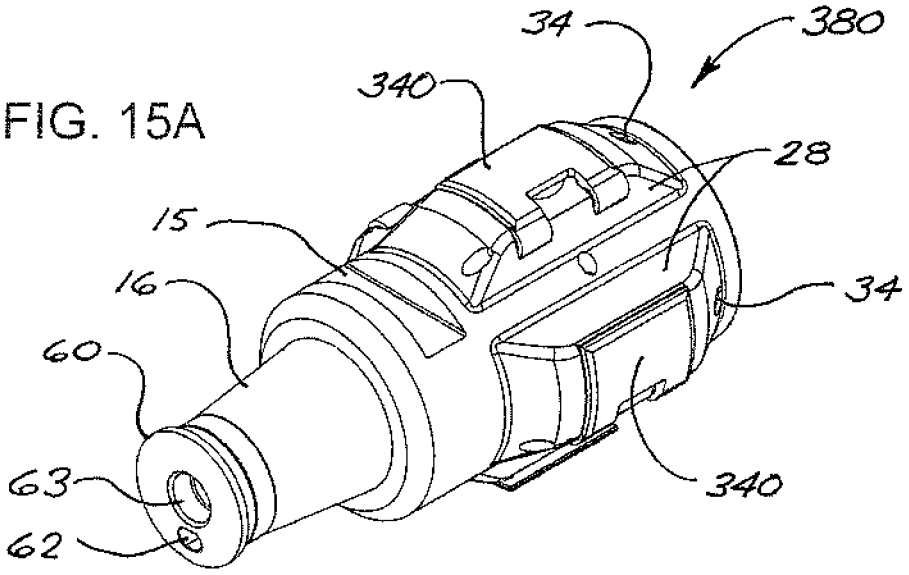
FIG. 15A is an isometric view of the steering section of the rotary drilling apparatus in FIG. 12, with a hinged reaction member mounted to the steering section in association with each piston.
Figure 15B:
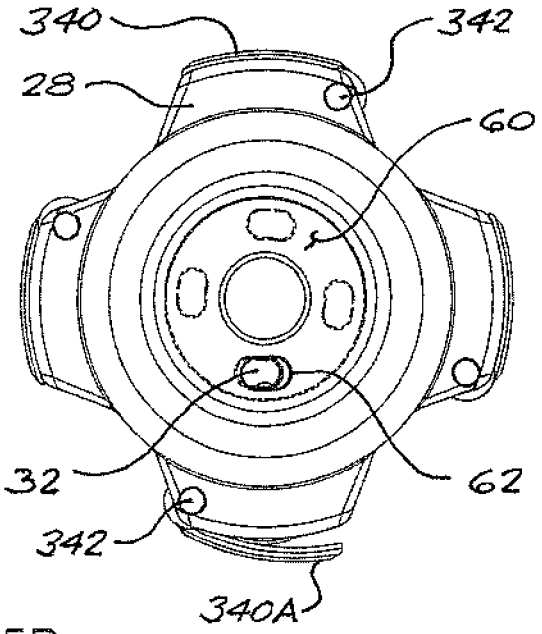
FIG. 15B is a top end view of the apparatus in FIG. 15A, showing the upper and lower plates of the piston-actuating mechanism, the piston housings, and the hinged reaction members.
Figure 15C:
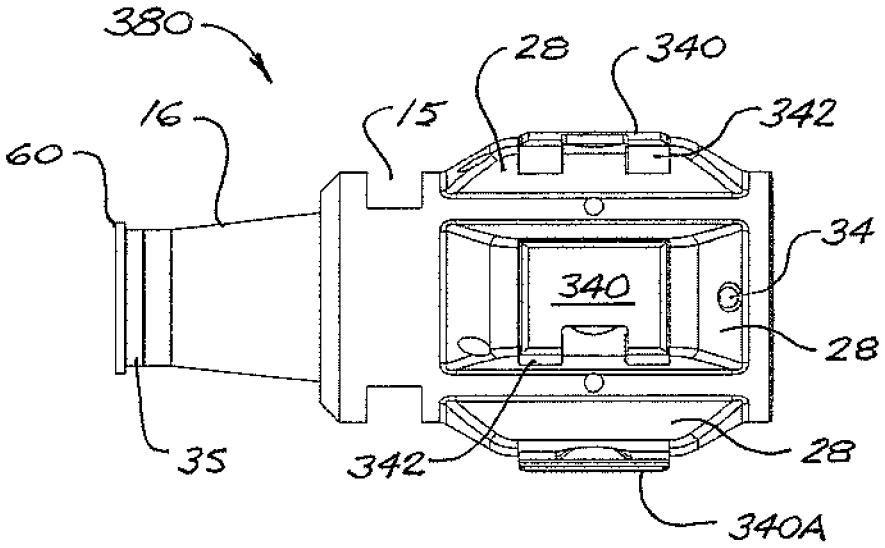
FIG. 15C is a side view of the apparatus in FIG. 15A, with one piston actuated and deflecting its associated hinged reaction member.
Figure 15D:
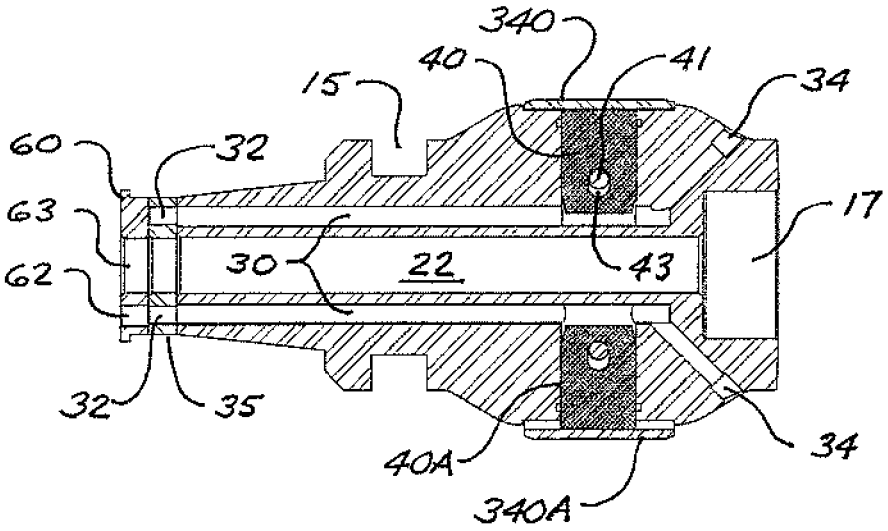
FIG. 15D is a longitudinal cross-section through the apparatus in FIG. 15A, with one piston actuated and deflecting its associated hinged reaction member.
Figure 16A:
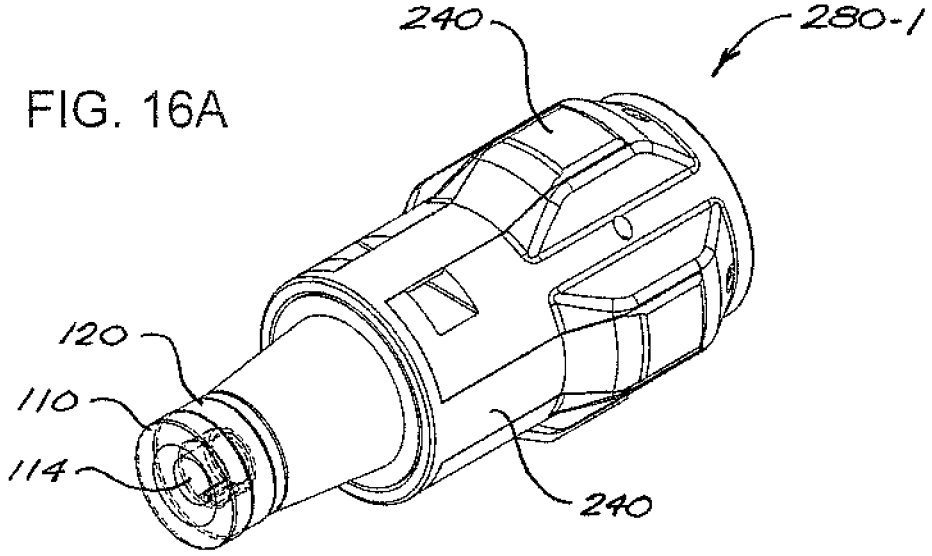
FIG. 16A is an isometric view of a variant of the steering section of the rotary drilling apparatus in FIG. 12, with the fluid-metering assembly incorporating a sleeve assembly as in FIGS. 2-6.
Figure 16B:
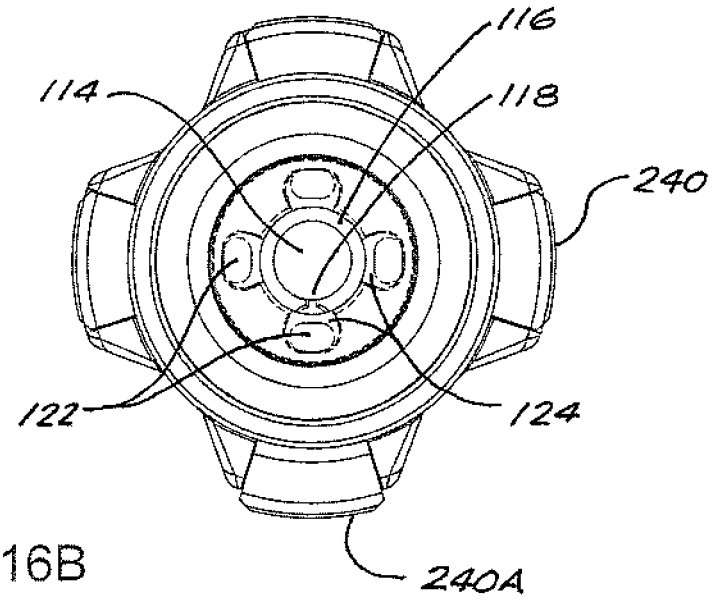
FIG. 16B is a top end view of the apparatus in FIG. 16A, showing the upper and lower sleeves of the piston-actuating mechanism, the piston housings, and the resiliently-mounted flexible reaction members.
Figure 16C:
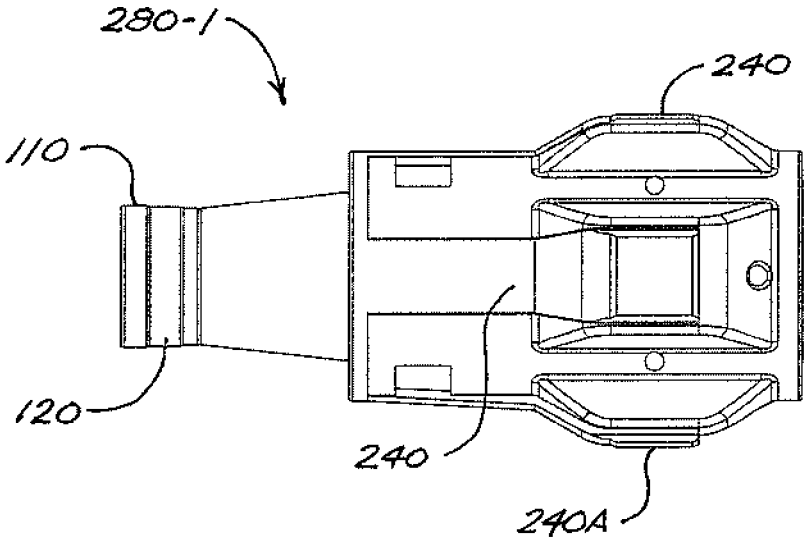
FIG. 16C is a side view of the apparatus in FIG. 16A, with one piston actuated and deflecting its associated flexible reaction member.
Figure 16D:
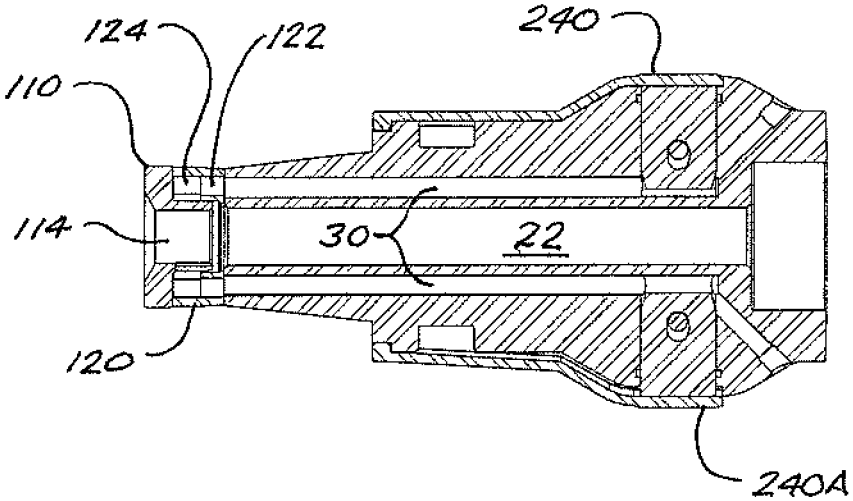
FIG. 16D is a longitudinal cross-section through the apparatus in FIG. 16A, with one piston actuated and deflecting its associated flexible reaction member.

As best appreciated with reference to the upper portion of FIG. 15D, when a given piston 40 is in its retracted position, its associated hinged reaction pad 340 preferably lies flush or nearly so with the surface of the associated piston housing 28. However, when a piston is actuated (as illustrated by actuated piston 40A in the lower portion of FIG. 15D), it pushes radially outward against its corresponding hinged reaction pad 340A, causing pad 340A to pivot about its hinge point(s) 342 and deflect radially outward toward and against the wall of the wellbore, as seen in FIGS. 15C and 15D. This results in steering section 380 and cutting structure 90 being pushed in the radially opposite direction. When actuated piston 40A retracts into its piston housing 28, the deflected hinged reaction pad 340A can be returned to its original position, assisted as appropriate by suitable biasing means.

FIGS. 16A, 16B, 16C, and 16D illustrate a variant 280-1 of steering section 280 shown in FIGS. 14A, 14B, 14C, and 14D, with the only difference being that the fluid-metering assembly in steering section 280-1 incorporates upper and lower sleeves 110 and 120 as in FIGS. 3A-3C and 4A-4C, rather than upper and lower plates 60 and 35 as in steering section 280. Components and features not having reference numbers in FIGS. 16A, 16B, 16C, and 16D correspond to like components and features shown and referenced in FIGS. 14A, 14B, 14C, and 14D. Persons skilled in the art will also appreciate that steering section 380 shown in FIGS. 15A, 15B, 15C, and 15D could be similarly adapted.

Embodiments of RSS tools in accordance with the principles described herein may use pistons of any functionally suitable type and construction, and the disclosure is not limited to the use of any particular type of piston described or illustrated herein. FIGS. 12, 14D, 15D, and 16D, for instance, show unitary or one-piece pistons 40. FIGS. 17A to 21 illustrate an embodiment of an alternative piston assembly 140 comprising an outer (or upper) member 150, an inner (or lower) member 160, and, in preferred embodiments, a biasing spring 170. In this description of piston assembly 140 and its constituent elements, the adjectives "inner" and "outer" are used relative to the centerline of a steering section 80 in conjunction with which piston 140 is installed; i.e., inner member 160 will be disposed radially inward of outer member 150, while outer member 150 is extendable radially outward from steering section 80 (and away from inner member 160). However, for convenience in describing these components, the adjectives "upper" and "lower" may be used interchangeably with "outer" and "inner", respectively, in correspondence with the graphical representation of these elements in FIGS. 17A to 21.

Figure 17A:
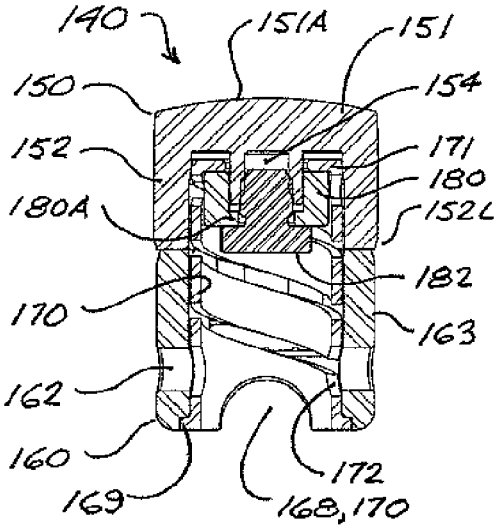
FIG. 17A is a cross-section through an embodiment of a piston assembly in accordance with the principles described herein, shown in a retracted position.
Figure 17B:
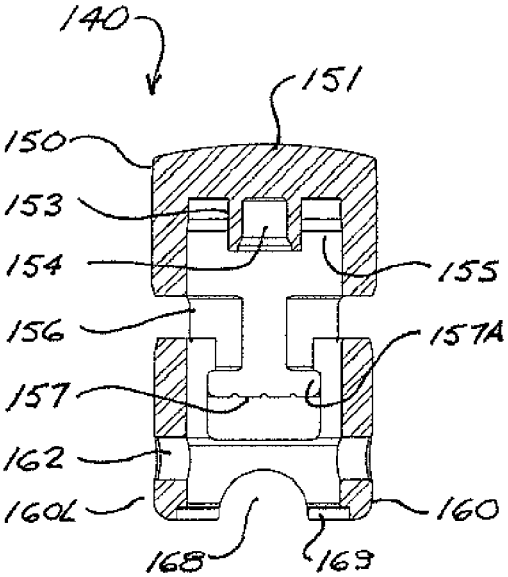
FIG. 17B is a cross-section through the piston assembly in FIG. 17A, shown in an extended position (and with the biasing spring not shown for clarity of illustration).

As shown in particular detail in FIGS. 17A and 17B, outer member 150 of piston assembly 140 has a cylindrical sidewall 152 with an upper end 152U closed off by a cap member 151, and an open lower end 152L. The upper (or outer) surface 151A of cap member 151 may optionally be contoured as shown in FIGS. 17A, 17B, 18A, and 18B to conform with the effective diameter of a cutting structure 90 mounted to steering section 80, in embodiments intended for direct piston contact with a wellbore wall, without intervening reaction members. The embodiment of outer member 150 shown in FIGS. 17A and 17B is adapted to receive the upper end of biasing spring 170 (in a manner to be described later herein), and for that purpose is formed with a cylindrical boss 153 projecting coaxially downward from cap member 151 and having an open-bottomed and internally-threaded cavity 154. An open-bottomed annular space 155 is thus formed between boss 153 and sidewall 152 of outer member 150.

Extending downward from cylindrical sidewall 152 are a pair of spaced, curvilinear, and diametrically-opposed sidewall extensions 156, each having a lower portion 157 formed with a circumferentially-projecting lug or stop element 157A at each circumferential end of lower portion 157. Each sidewall extension 156 can thus be described as taking the general shape of an inverted "T", with a pair of diametrically-opposed sidewall openings 156A being formed between the two sidewall extensions 156.

Inner member 160 of piston assembly 140 has a cylindrical sidewall 161 having an upper end 160U and a lower end 160L, and enclosing a cylindrical cavity 165 which is open at each end. A pair of diametrically-opposed retainer pin openings 162 are formed through sidewall 161 for receiving a retainer pin 145 for securing inner member 160 to and within steering section 80, such that the position of inner member 160 relative to steering section 80 will be radially fixed. A pair of diametrically-opposed fluid openings 168 (semi-circular or semi-ovate in the illustrated embodiment) are formed into sidewall 161 of inner member 160, intercepting lower end 160L of inner member 160 and at right angles to retainer pin openings 162, so as to be generally aligned with corresponding fluid channels 30 when piston 40 is installed in steering section 80, to permit passage of drilling fluid downward beyond inner member 160 and into a corresponding bit jet 34 in steering section 80. As best seen in FIG. 17B, and for purposes to be described later herein, an annular groove 169 is formed around cavity 165 at lower end 160U of inner member 160. In the illustrated embodiment, annular groove 169 is discontinuous, being interrupted by fluid openings 168.

Extending upward from cylindrical sidewall 161 are a pair of spaced, curvilinear, and diametrically-opposed sidewall extensions 163, each having an upper portion 164 formed to define a circumferentially-projecting lug or stop element 164A at each circumferential end of upper portion 164. Each sidewall extension 163 can thus be described as being generally T-shaped, with a pair of diametrically-opposed sidewall openings 163A being formed between the two sidewall extensions 163. In combination, lugs 157A and 164A thus serve as travel-limiting means defining the maximum radial stroke of outer member 150 of piston assembly 140.

Figure 18A:
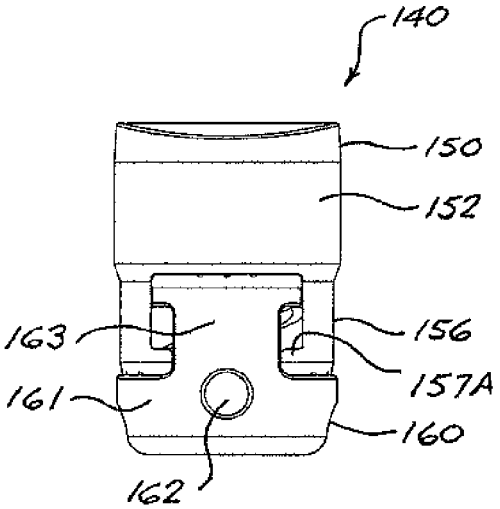
FIG. 18A is a side view of the piston assembly in FIGS. 17A and 17B, shown in a retracted position.
Figure 18B:
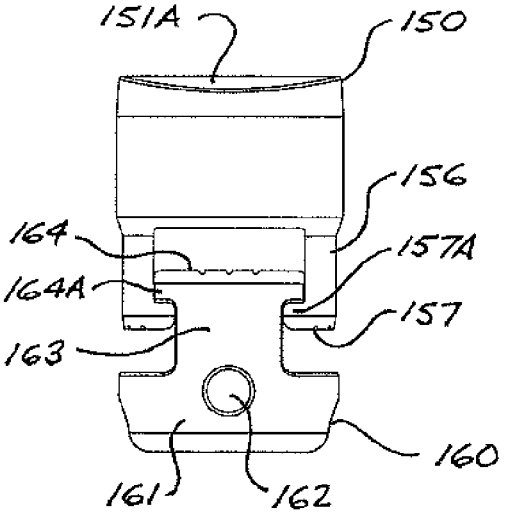
FIG. 18B is a side view of the piston assembly in FIGS. 17A and 17B, shown in an extended position.
Figure 19A:
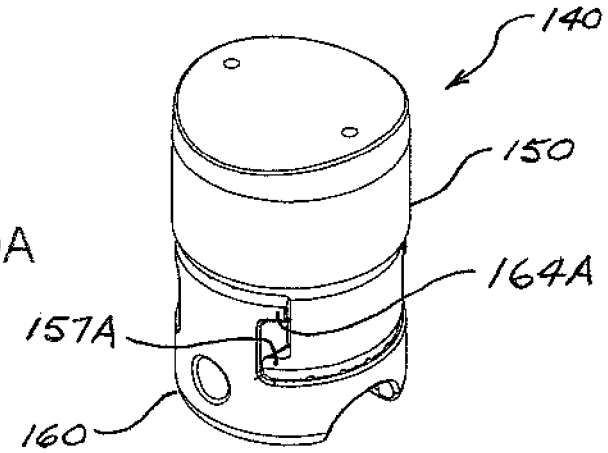
FIG. 19A is an isometric view of the piston assembly in FIGS. 17A-18B, shown in a retracted position.
Figure 19B:
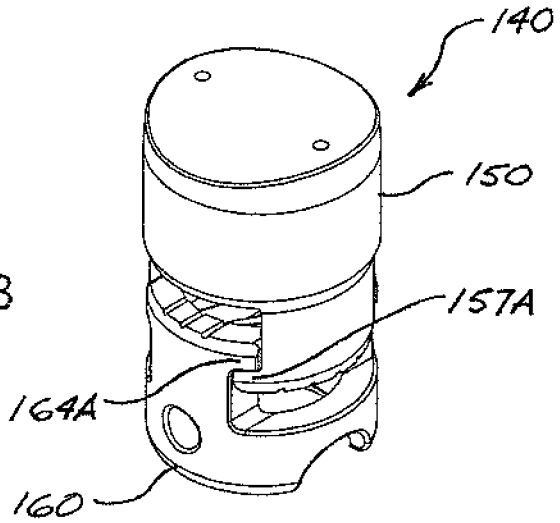
FIG. 19B is an isometric view of the piston assembly in FIGS. 17A-18B, shown in an extended position.

As may be best understood with reference to FIGS. 18A, 18B, 19A, and 19B, outer member 150 and inner member 160 may be assembled by laterally inserting upper portions sidewall extensions 163 of inner member 160 into sidewall openings 156A of outer member 150 such that outer member 150 and inner member 160 are in coaxial alignment. Outer member 150 is axially movable relative to inner member 160 (i.e., radially relative to steering section 80), with the outward axial movement of outer member 150 being limited by the abutment of lugs 157A on outer member 150 against lugs 164A on inner member 160, as seen in FIGS. 17B, 18B, and 19B.

Figure 21:
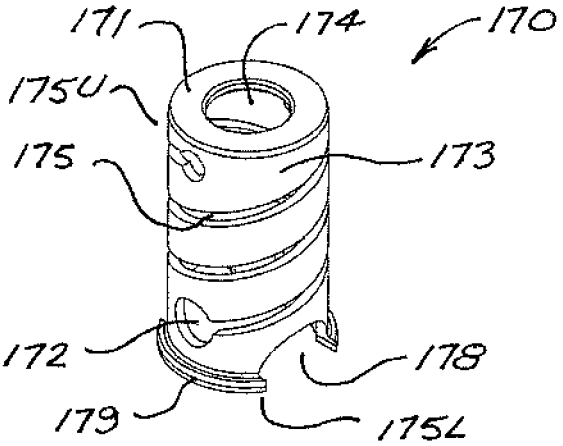
FIG. 21 is an isometric view of the biasing spring of the piston assembly in FIGS. 17A-19B.

Biasing spring 170, shown in isometric view in FIG. 21, comprises a cylindrical sidewall 173 having an upper end 173U and a lower end 173L, and defining a cylindrical inner chamber 174. Upper end upper end 173U of sidewall 173 is formed or provided with an inward-projecting annular flange 171, and lower end 173L of sidewall 173 is formed or provided with an outward-projecting annular lip 179. A helical slot 175 is formed through sidewall 173 such that sidewall 173 takes the form of a helical spring, with helical slot 175 having an upper terminus adjacent to annular flange 171 and a lower terminus adjacent to annular lip 179. A pair of diametrically-opposed retainer pin openings 172 are formed through sidewall 173 for receiving a retainer pin 145 when biasing spring 170 is assembled with inner member 160 of piston assembly 140 and installed in a steering section 80 (as will be described later herein). In the illustrated embodiment of spring 170, the lower terminus of helical slot 175 coincides with one of the retainer pin openings 172, but this is for convenience rather than for any functionally essential reason. A pair of diametrically-opposed fluid openings 168 (semi-circular or semi-ovate in the illustrated embodiment) are formed into sidewall 173, intercepting lower end 173L of sidewall 173 and at right angles to retainer pin openings 172, so as to be generally aligned with fluid openings 168 in sidewall 161 of inner member 160 when biasing spring 170 is assembled with inner member 160.

Figure 22:
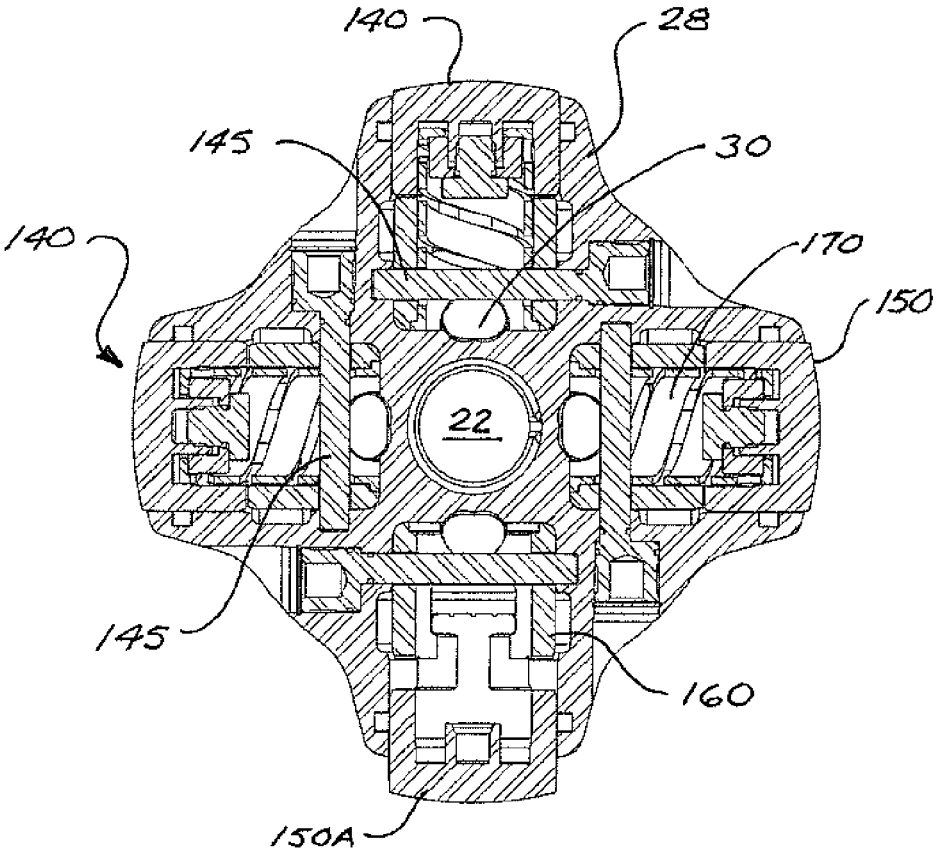
FIG. 22 is a transverse cross-section through the steering section of the rotary drilling apparatus in FIG. 2, incorporating piston assemblies in accordance with FIGS. 17A-21.

The assembly of piston assembly 140 may be best understood with reference to FIGS. 17A, 17B, and 22. The first assembly step is to insert biasing spring 170 upward into cavity 165 of inner member 160 such that annular lip 179 on biasing spring 170 is retainingly engaged within annular groove 169 at lower end 160L of inner member 160. The next step is to assemble the sub-assembly of inner member 160 and biasing spring 170 with outer member 150, by inserting the upper end of biasing spring 170 into the lower end of outer member 150 such that flange 171 of biasing spring 170 is disposed within annular space 155 in outer member 150. A generally cylindrical spacer 180 having an inward-projecting annular flange 180A at its lower end is then positioned over and around cylindrical boss 153, and a cap screw 182 is inserted upward through the opening in spacer 180 and threaded into threaded cavity 154 in boss 153, thus securing spacer 180 and the upper end of biasing spring 170 to outer member 150.

Thus assembled, piston 140 incorporates biasing spring 170 with its upper (outer) end securely retained within outer member 150 and with its lower (inner) end securely retained by inner member 160. Accordingly, when a piston-actuating fluid flows into the associated fluid channel 30 in steering section 80, fluid will flow into piston 140 and exert pressure against cap member 151 of outer member 150, so as to overcome the biasing force of biasing spring 170 and extend outer member 150 radially outward from steering section 80. When the fluid pressure is relieved, biasing spring 170 will return outer member 150 to its retracted position as shown in FIGS. 17A and 18A. The magnitude of the biasing force provided by biasing spring 170 can be adjusted by adjusting the axial position of cap screw 182, and/or by using spacers 180 of different axial lengths.

The assembled piston(s) 140 can then be mounted into steering section 80 as shown in FIG. 22. Retainer pins 145 are inserted through transverse openings in steering section 80 and through retainer pin openings 162 and 172 in inner member 160 and biasing spring 170 respectively, thereby securing inner member 160 and the lower end of biasing spring 170 against radial movement relative to steering section 80.

The particular configuration of biasing spring 170 shown in the Figures, and the particular means used for assembling biasing spring 170 with outer member 150 and inner member 160, are by way of example only. Persons skilled in the art will appreciate that alternative configurations and assembly means may be devised in accordance with known techniques, and such alternative configurations and assembly means are intended to come within the scope of the present disclosure.

Piston assembly 140 provides significant benefits and advantages over existing piston designs. The design of piston assembly 140 facilitates a long piston stroke within a comparatively short piston assembly, with a high mechanical return force provided by the integrated biasing spring 170. This piston assembly is also less prone to debris causing pistons to bind within the steering section or limiting piston stroke when operating in dirty fluid environments. It also allows a spring-preloaded piston assembly to be assembled and secured in place within the steering section using a simple pin, without the need to preload the spring during insertion into the steering section, making the piston assembly easier to service or replace.

Embodiments Incorporating Filter Module

Figure 23:
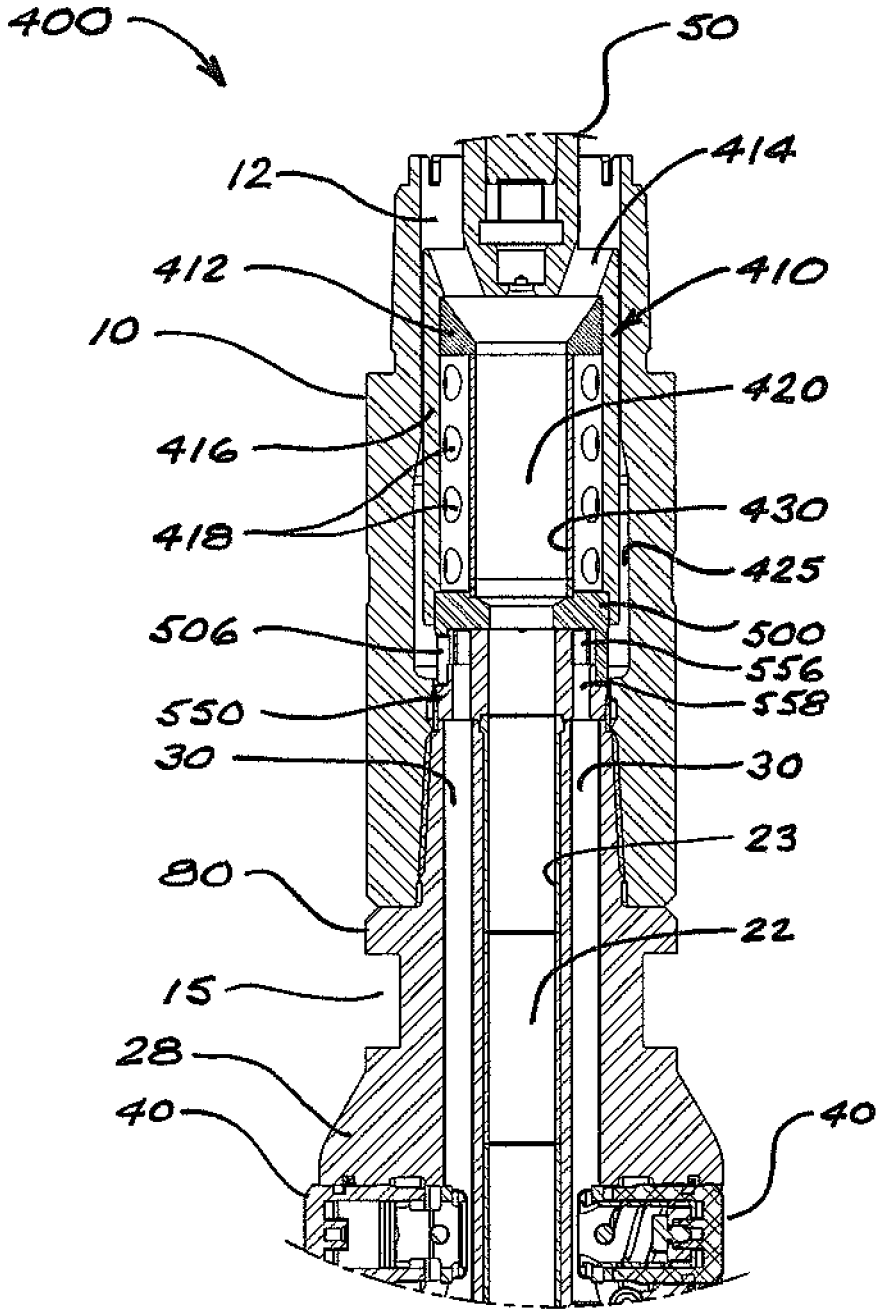
FIG. 23 is a longitudinal cross-section through a first embodiment of the apparatus incorporating a filter module.

FIG. 23 illustrates an embodiment of an RSS tool 400 having a fluid-metering assembly incorporating an upper sleeve 500 and a lower sleeve 550. Tool 400 includes a generally cylindrical filter module 410 coaxially mounted between the lower end of control assembly 50 and upper sleeve 500, such that filter module 410 rotates with control assembly 50 and upper sleeve 500. Filter module 410 has a fluid passage 420 which at its upper end is in fluid communication with annular space 12 between control assembly 50 and housing 10, and at its lower end is in fluid communication with the bore 505 of upper sleeve 500.

Filter module 410 is axially movable within housing 10 (along with control assembly 50), with an upper portion of the cylindrical outer surface of the main body 412 of filter module 410 having a close-tolerance fit within the bore of housing 10, allowing passage of only very small particles. Adjacent a lower portion of filter module body 412, the bore of housing 10 is increased in diameter, forming an annular space (or "filter annulus") 425 between the cylindrical outer surface of filter module body 412 and the bore of housing 10. One or more fluid ports 418 are provided through the cylindrical wall 416 of filter module body 412, and one or more filter elements 430 are provided within fluid passage 420 to cover fluid ports 418. In one embodiment, fluid passage 420 is a cylindrical bore, and filter element 430 is a cylindrical screen fitted against the cylindrical bore so as to cover all of fluid ports 430.

As illustrated in detail in FIGS. 24A, 24B, 25, 26A, and 26B, upper sleeve 500 has an upper member 502 with a fluid opening or bore 505, and a cylindrical skirt 504 extending downward from upper member 502. A fluid port 506 is formed in skirt 504. The body of lower sleeve 550 comprises a lower cylindrical section 552 and an upper cylindrical section 554, with upper section 554 being small in diameter than lower section 552 such that upper section 554 can be coaxially inserted into the lower end of upper sleeve 500 with skirt 504 of upper sleeve 500 enclosing upper section 554 or lower sleeve 550. Upper section 554 of lower sleeve 550 has a plurality of radial recesses 558 (corresponding in number to the number of pistons in tool 400), and the same number of fluid inlets 556 are formed through lower section 552 of lower sleeve 550 such that each fluid inlet 556 is aligned with one of the recesses 558.

In operation of the tool 400, drilling fluid flows from housing annulus 12 into the fluid passage 420 of filter module 410 (via fluid entry ports 414 in the illustrated embodiment), with a portion of the fluid flow being diverted radially outward through fluid ports 418 through wall 416 of filter module body 412 and into filter annulus 425. The fluid exits filter annulus 425 through fluid port 506 in skirt 504 and into each recess 558 in lower sleeve 550 in sequence as upper sleeve 500 rotates around lower sleeve 550. Fluid entering each recess 558 flows through its corresponding fluid inlet in lower sleeve 550 and then into the associated fluid channel 30 in steering section 80 to actuate the associated piston 40. As with embodiments not having the filter module, upper sleeve 500 is axially movable to selectively enable fluid flow to all or none of the pistons, as may be desired to suit operational requirements.

As illustrated by way of example in FIG. 23, fluid passage 22 in RSS tools in accordance with the present disclosure optionally may be lined with carbide sleeves 23 to protect against wear caused by the flow of abrasive drilling fluids.

Figure 24B:
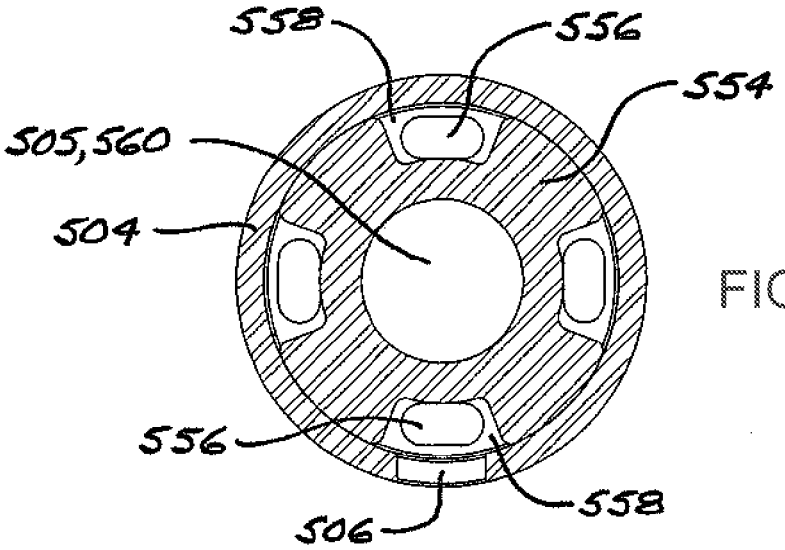
FIG. 24B is a transverse cross-section through the sleeve assembly in FIG. 24A, taken through the radial slot in the upper sleeve and the radial recesses in the lower sleeve.
Figure 24A:
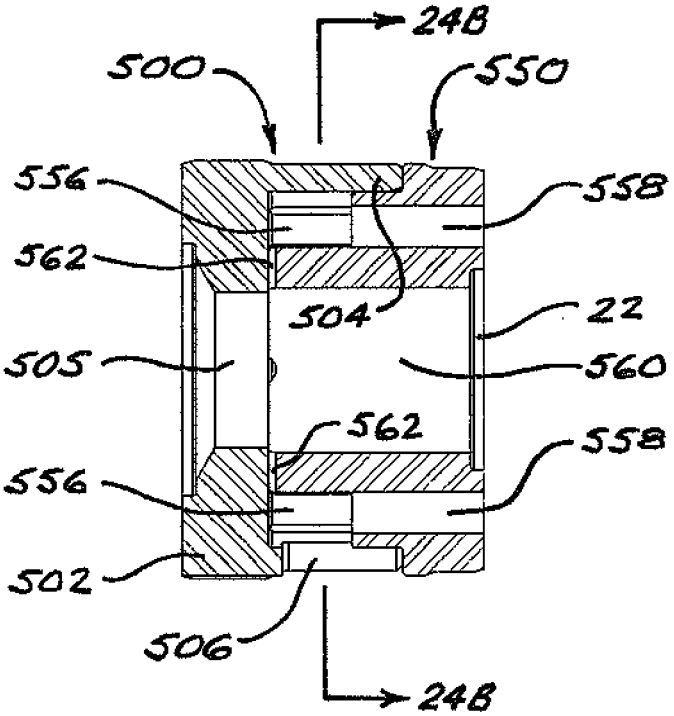
FIG. 24A is an enlarged detail of the upper and lower sleeves of the fluid-metering assembly in the embodiment shown in FIG. 23.
Figure 25:
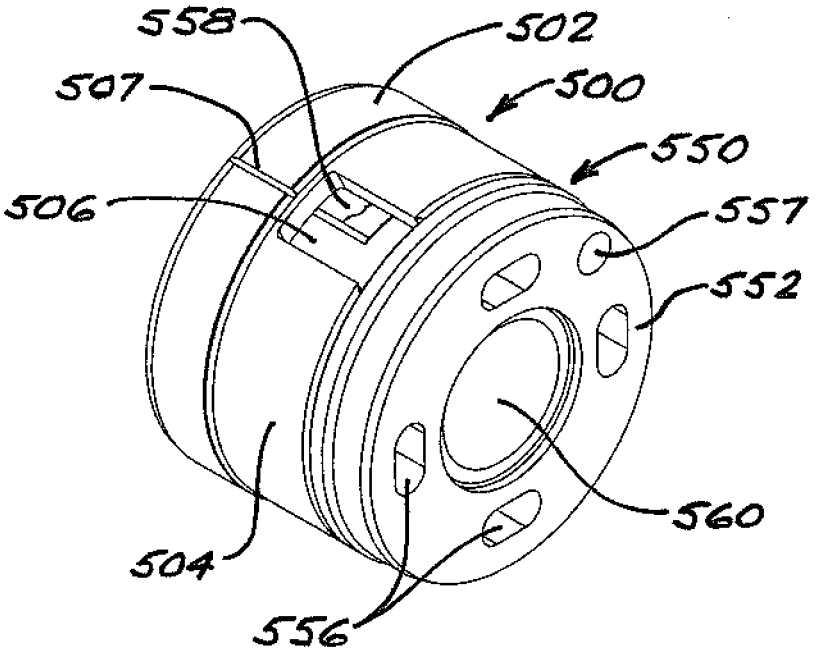
FIG. 25 is an isometric view of the sleeve assembly shown in FIGS. 24A and 24B.
Figure 25A:
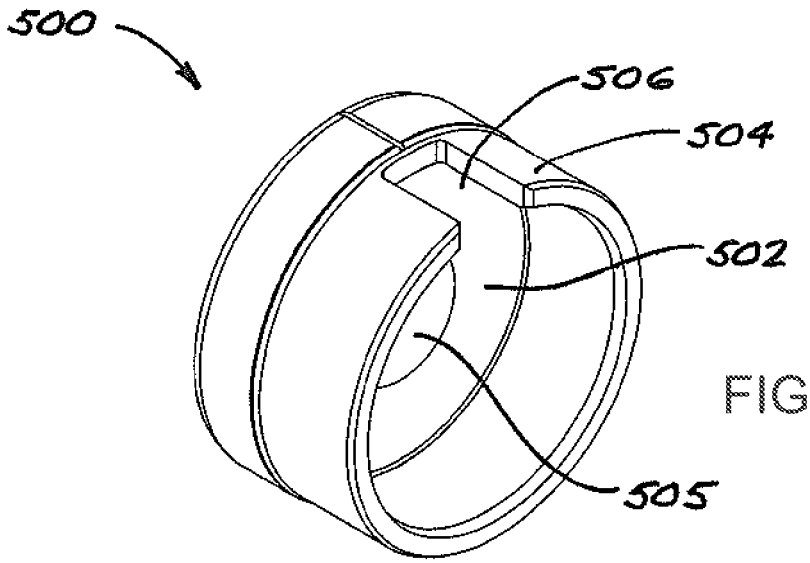
FIGS. 25A and 25B are isometric views, respectively, of the upper and lower sleeves shown in FIGS. 24A, 24B, and 25.
Figure 25B:
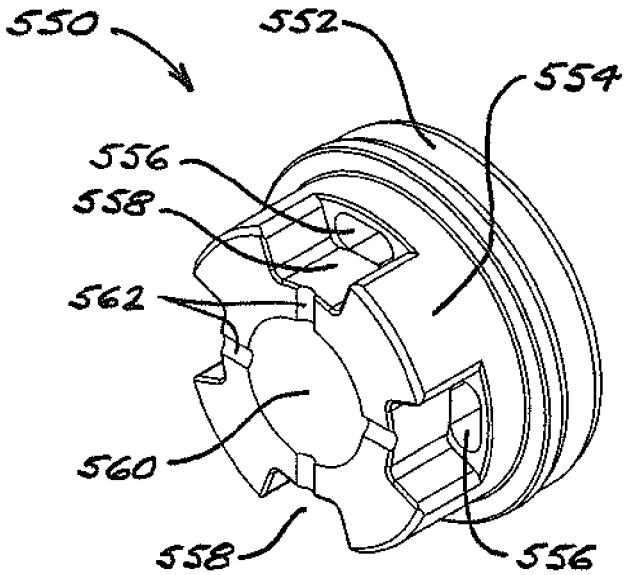

Optionally, and as shown in FIGS. 24A and 25B, radial grooves 562 may be provided in the upper end of upper section 554 of lower sleeve 550 to allow increased fluid leakage to the fluid channels 30 and related passages leading to pistons 40.

As shown in FIG. 25, upper sleeve 500 optionally may be provided with an alignment slot 507 or similar means for facilitating alignment of the fluid-metering assembly with the filter assembly. Also optional is an alignment hole 557 to keep the fluid-metering assembly from rotating during assembly.

Figure 26:
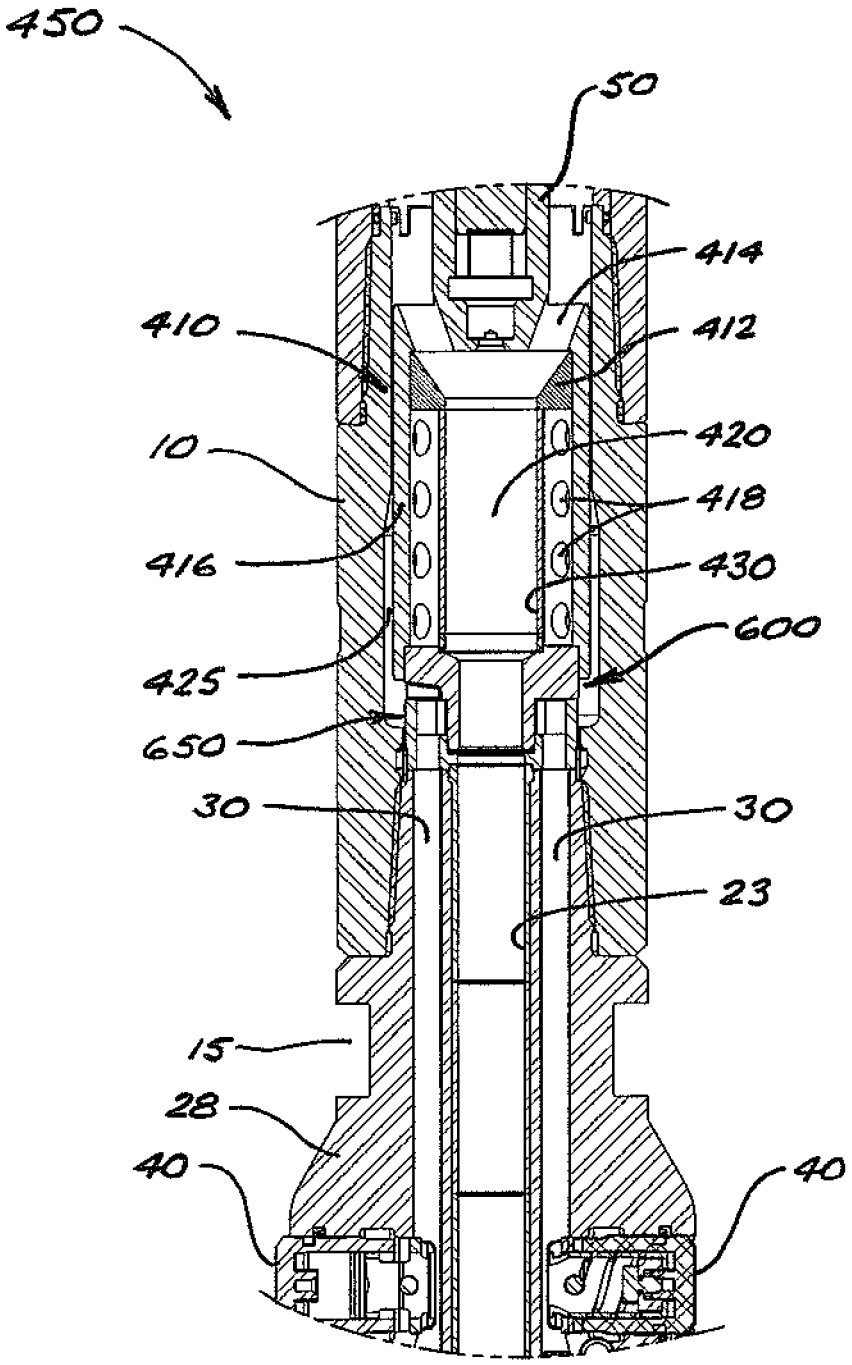
FIG. 26 is a longitudinal cross-section through a second embodiment of the apparatus incorporating a filter module.

FIG. 26 illustrates an RSS tool 450 generally similar to RSS tool 400 previously described, including the incorporation of a filter module 410, but having a variant fluid-metering assembly incorporating an upper sleeve 600 and a lower sleeve 650.

Figure 27B:
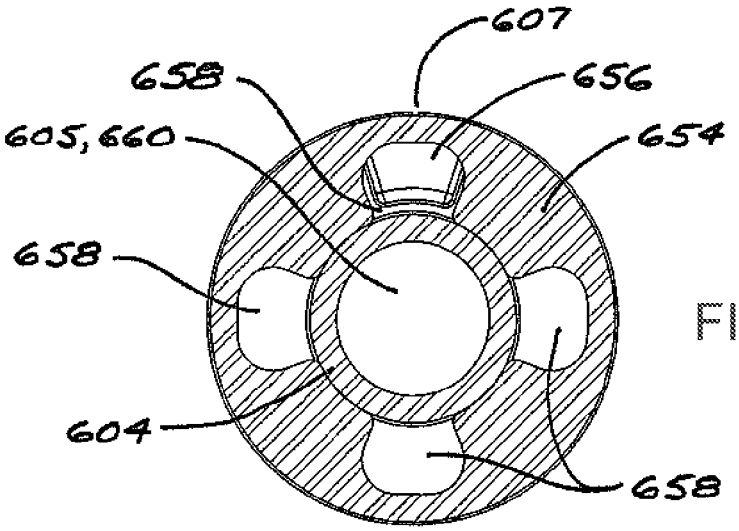
FIG. 27B is a transverse cross-section through the sleeve assembly in FIG. 27A, taken through the radial slot in the upper sleeve and the radial recesses in the lower sleeve.
Figure 27A:
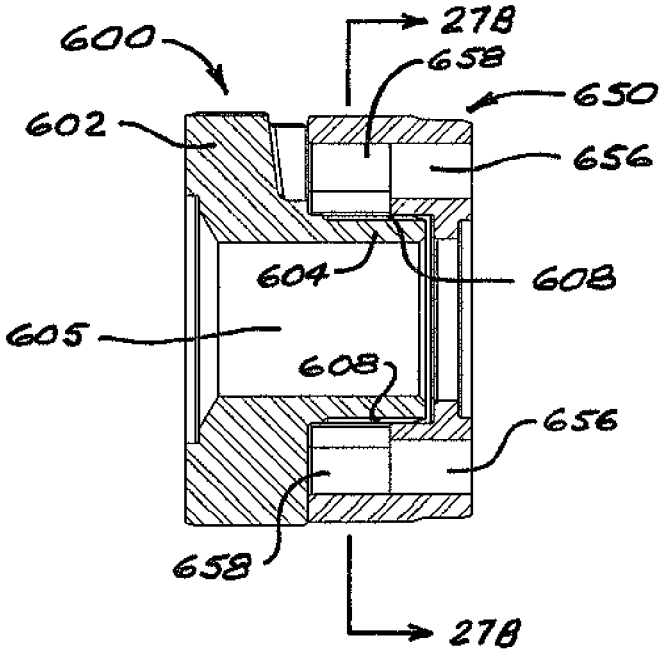
FIG. 27A is an enlarged detail of the upper and lower sleeves of the fluid-metering assembly in the embodiment shown in FIG. 26.

As illustrated in detail in FIGS. 27A, 27B, 28, 28A, and 28B, upper sleeve 600 has an upper flange member 602 and a cylindrical section 604 extending downward from upper flange member 602, with a bore 605 extending through the length of upper sleeve 600. A fluid entry port 606 is formed in a lower region of upper member 502, as most clearly seen in FIG. 28A. Lower sleeve 650 is generally similar to lower sleeve 120 shown in FIG. 4A, having a bore 660 and a number of fluid inlets 656 geometrically arrayed to correspond with the fluid channels 30 in steering section 80. Recesses 658 are formed into an upper region of lower sleeve 650 to provide fluid communication between each fluid inlet 656 and bore 660. Accordingly, and as best seen in FIG. 27A, when cylindrical section 604 of upper sleeve 600 is disposed within bore 660 of lower sleeve 650, with fluid entry port 606 aligned with a given recess 658 in lower sleeve 650, bore 605 of upper sleeve 600 will be in fluid communication with the corresponding fluid channel 30 in steering section 80, via fluid entry port 606, recess 658, and fluid inlet 656.

The operation of RSS tool 450 is otherwise similar to the operation of RSS tool 400 as previously described, with fluid entering fluid annulus 425 entering the fluid-metering assembly through fluid entry port 606 in upper sleeve 600.

Optionally, and as shown in FIGS. 27A and 287B, longitudinal grooves 608 may be provided in the outer surface of cylindrical section 604 of upper sleeve 600 to allow increased fluid leakage to the fluid channels 30 and related passages leading to pistons 40. As an alternative to grooves 608, radial slots could be provided through the wall of cylindrical section 604. In another variant, radial slots could be provided in combination with one or more grooves 608, with the radial slots being either aligned with or offset from grooves 608.

Figure 28:
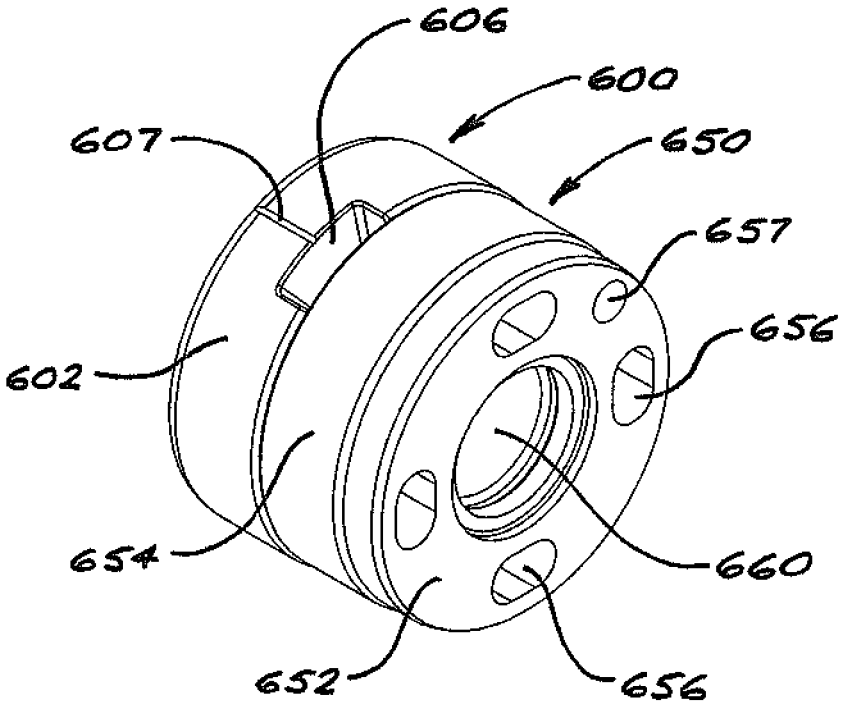
FIG. 28 is an isometric view of the sleeve assembly shown in FIGS. 27A and 27B.
Figure 28A:
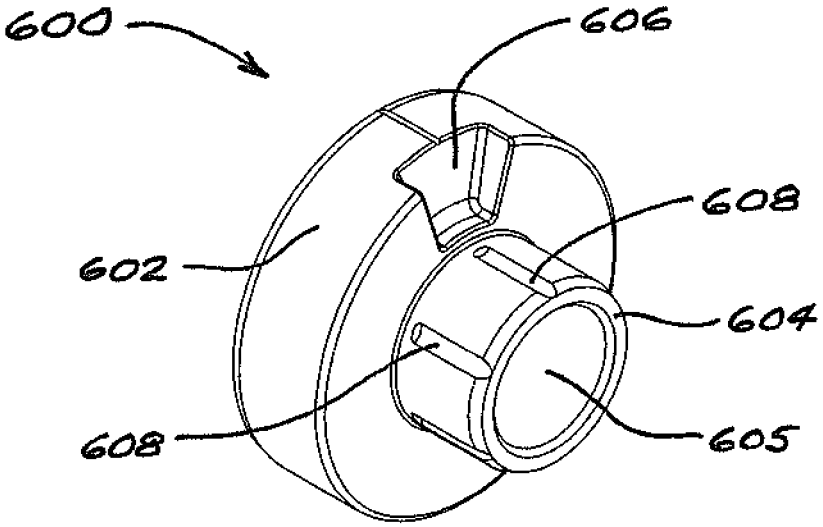
FIGS. 28A and 28B are isometric views, respectively, of the upper and lower sleeves shown in FIGS. 27A, 27B, and 28.
Figure 28B:
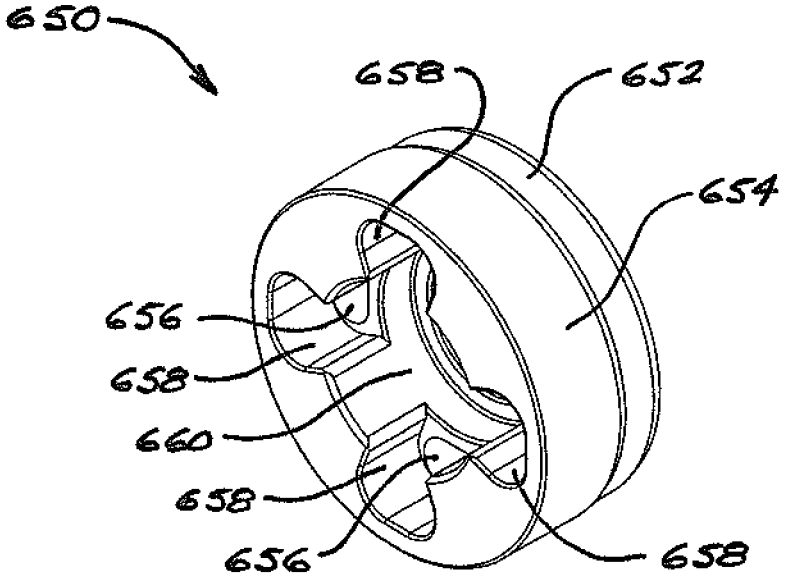

As shown in FIG. 28, upper sleeve 600 optionally may be provided with an alignment slot 607 or similar means for facilitating alignment of the fluid-metering assembly with the filter assembly. Also optional is an alignment hole 657 to keep the fluid-metering assembly from rotating during assembly.

Figure 29:
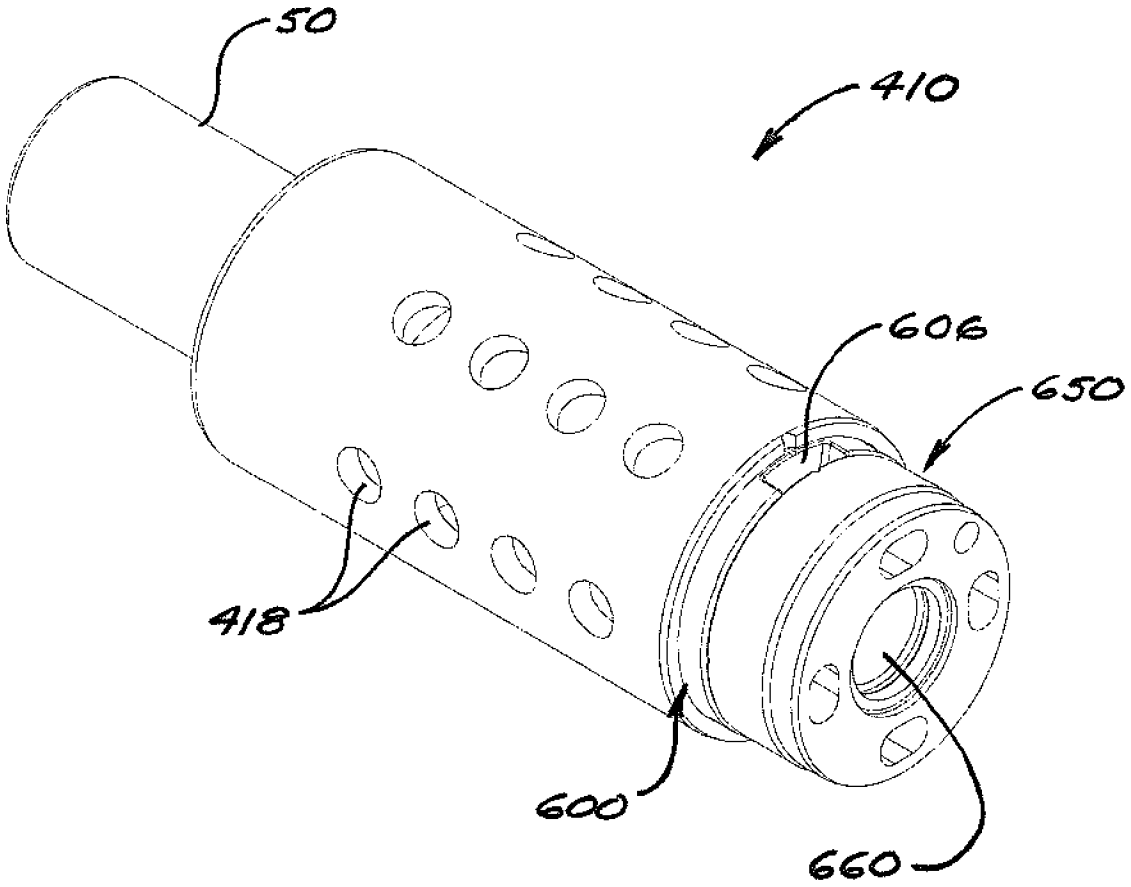
FIG. 29 is an isometric view of an embodiment of a filter module in accordance with the principles described herein, shown mounted in conjunction with a sleeve assembly as in FIG. 26.

FIG. 29 is an isometric view of a filter assembly as shown in FIG. 26, incorporating a fluid-metering assembly comprising rotating upper sleeve 600 and fixed lower sleeve 650. The filter assembly shown in FIG. 23 would look the same except for the substitution of rotating upper sleeve 500 and fixed lower sleeve 550.

Embodiments Incorporating Auxiliary Cutting Elements

Figure 20A:
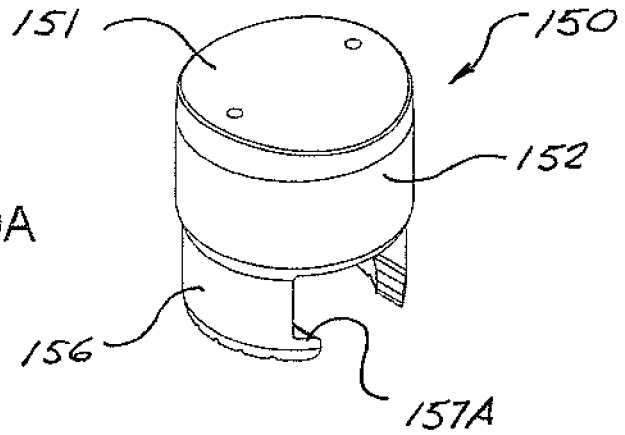
FIG. 20A is an isometric view of the outer member of the piston assembly in FIGS. 17A-19B.
Figure 20B:
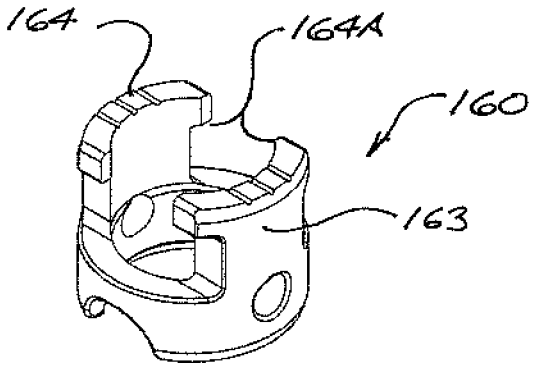
FIG. 20B is an isometric view of the inner member of the piston assembly in FIGS. 17A-19B.
Figure 30:
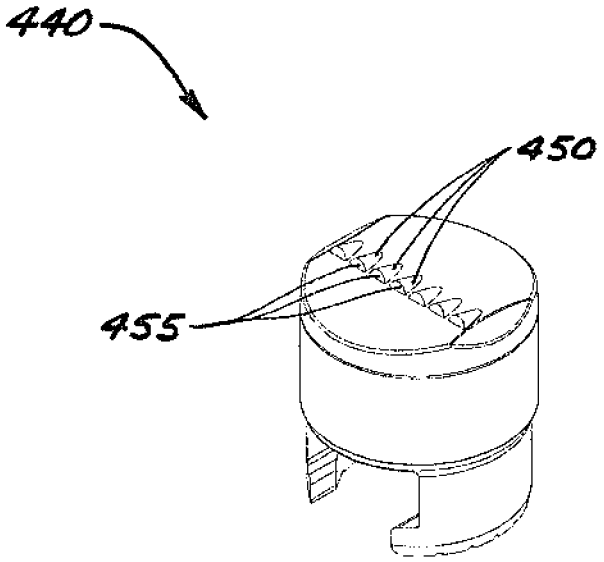
FIG. 30 is an isometric view of an embodiment of a bit-deflecting piston in accordance with the principles described herein incorporating auxiliary cutting elements.

FIG. 30 illustrates a piston 440 in accordance with an alternative embodiment, generally similar to piston 150 shown in FIG. 20A but having auxiliary cutting elements 450 to provide a reaming capability close to the bit. In the embodiment shown in FIG. 30, cutting elements 450 are of generally tooth-like configuration, with cutting faces 455 on one end and aligned for effective cutting action when the tool in which pistons 450 are mounted is rotated in a corresponding direction. However, the configuration of cutting elements 450 shown in FIG. 30 is by way of non-limiting example only, and persons skilled in the art will readily appreciate that other functionally suitable types and configurations of cutting elements could be incorporated into pistons or piston pads as taught in the present disclosure for purposes of providing the tool with near-bit reaming capability, without significantly affecting the function of the pistons or piston pads for purposes of bit-steering when drilling deviated wellbores.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

The invention claimed is:

1. A drilling apparatus for drilling a borehole in a subterranean formation, the drilling apparatus comprising:

a body having a central axis, an upper end, a lower end, a central channel extending axially from the upper end, and a plurality of circumferentially-spaced fluid channels extending axially from the upper end and radially spaced from the central channel, wherein the central channel is configured to flow drilling fluid through the body;

a plurality of pistons housed in the body, wherein each fluid channel in the body extends to one of the piston and is configured to flow drilling fluid to the corresponding piston, wherein each piston is configured to move radially outward relative to the body in response to drilling fluid supplied by the corresponding fluid channel, and wherein each piston has a formation facing surface including a plurality of cutting elements configured to engage the formation;

a fluid-metering assembly configured to selectively meter the flow of drilling fluid into the fluid channels, wherein the fluid-metering assembly includes an upper component and a lower component;

wherein the upper component includes a central through bore;

wherein the lower component includes a central through bore and a plurality of circumferentially-spaced fluid inlets disposed about the central through bore of the lower component, wherein the central through bore of the lower component is in fluid communication with the central through bore of the upper component and the central channel of the body, and wherein the each fluid inlet of the lower component is in fluid communication with one of the fluid channels of the body;

wherein the upper component is configured to move relative to the lower component to control the distribution of drilling fluid between the central through bore of the lower component and the fluid inlets of the lower component.

2. The drilling apparatus of claim 1, wherein the upper component is configured to move axially relative to the lower component between:

a first position allowing drilling fluid to flow from the central through bore of the first component into all of the fluid inlets of the second component simultaneously; and a second position preventing drilling fluid from flowing from the central through bore of the first component into any of the fluid inlets of the second component.

3. The drilling apparatus of claim 2, wherein the upper component is configured to move axially relative to the lower component between:

the first position;

an intermediate position allowing drilling fluid to flow from the central through bore of the upper component into one of the fluid inlets of the lower component at a time; and the second position.

4. The drilling apparatus of claim 3, wherein the upper component is configured to rotate about the central axis relative to the lower component to place a fluid port of the upper component into fluid communication with one of the fluid channels of the lower component, wherein the fluid port of the upper component is radially spaced from the central through bore of the upper component.

5. The drilling apparatus of claim 1, wherein the upper component comprises an annular upper member including the central through bore of the upper component and a cylindrical skirt extending axially from the upper member, wherein a fluid port extends radially through the cylindrical skirt;

wherein the cylindrical skirt is disposed about and slidingly engages the lower component.

6. The drilling apparatus of claim 5, wherein the lower component includes an upper cylindrical section coaxially disposed within the cylindrical skirt of the upper component and a lower cylindrical section extending axially from the cylindrical skirt of the upper component;

wherein an outer surface of the upper cylindrical section includes a plurality of circumferentially-spaced radial recesses, and wherein one of the fluid inlet extends axially from each of the radial recesses through the lower section.

7. The drilling apparatus of claim 1, further comprising a filter module coupled to the upper component, wherein the upper component is axially positioned between the filter module and the lower component, and wherein the filter module is configured to filter the drilling fluid passing into any of the fluid inlets of the second component.

8. The drilling apparatus of claim 1, wherein the body is a drill bit comprising a cutting structure disposed at the lower end.

9. A drilling apparatus for drilling a borehole in a subterranean formation, the drilling apparatus comprising:

a control assembly disposed within a cylindrical housing;

a drill bit having a central axis, a first end coupled to the housing, a second end distal the housing, a central channel extending axially from the first end, and a plurality of circumferentially-spaced fluid channels extending axially from the first end, wherein the central channel is configured to flow drilling fluid through the drill bit to a cutting structure disposed at the second end of the drill bit;

a plurality of pistons housed in the drill bit, wherein each fluid channel in the drill bit extends to one of the piston and is configured to flow drilling fluid to the corresponding piston, wherein each piston is configured to move radially outward in response to drilling fluid supplied by the corresponding fluid channel, and wherein each piston has a formation facing surface including a plurality of cutting elements configured to engage the formation;

a fluid-metering assembly configured to selectively meter the flow of drilling fluid into the fluid channels of the drill bit, wherein the fluid-metering assembly includes a first component coupled to the control assembly and a second component coupled to the drill bit;

wherein the first component includes a central through bore and a fluid port radially spaced from the central through bore;

wherein the second component includes a central through bore and a plurality of circumferentially-spaced fluid inlets, wherein the central through bore of the second component is in fluid communication with the central through bore of the first component and the central channel of the drill bit, and wherein each fluid inlet of the second component is in fluid communication with one of the fluid channels of the drill bit;

wherein the control assembly is configured to move the first component axially relative to the second component between:

a first position allowing drilling fluid to flow from the central through bore of the first component into all of the fluid inlets of the second component simultaneously; and a second position preventing drilling fluid from flowing from the central through bore of the first component into any of the fluid inlets of the second component.

10. The drilling apparatus of claim 9, wherein the control assembly is configured to move the first component axially relative to the second component between:

the first position;

an intermediate position allowing drilling fluid to flow from the central through bore of the first component into at least one of the fluid inlets of the second component at a time; and the second position.

11. The drilling apparatus of claim 9, wherein the control assembly is configured to rotate the first component relative to the second component to selectively place the fluid port of the first component into fluid communication with one of the fluid channels of the second component.

12. The drilling apparatus of claim 9, wherein the cutting elements of the pistons are configured to ream a sidewall of the borehole with the first component in the first position.

13. The drilling apparatus of claim 9, wherein the first component comprises an annular upper member including the central through bore of the first component and a cylindrical skirt extending axially from the upper member, wherein the fluid port extends radially through the cylindrical skirt;

wherein the cylindrical skirt is disposed about and slidingly engages the second component.

14. The drilling apparatus of claim 13, wherein the second component includes an upper cylindrical section coaxially disposed within the cylindrical skirt of the first component and a lower cylindrical section extending axially from the cylindrical skirt of the first component;

wherein an outer surface of the upper cylindrical section includes a radial recess and the fluid inlet extends axially from the radial recess through the lower section.

15. The drilling apparatus of claim 9, wherein the first component comprises an upper flange and a cylindrical sleeve extending axially from the upper flange, wherein the central through bore of the first component extends axially through the upper flange and the cylindrical sleeve, and wherein the fluid port of the first component extends radially through the upper flange;

wherein the second component has an upper end, a lower end, and a plurality of circumferentially-spaced recesses extending axially from the upper end and radially from the central through bore of the second component, wherein each fluid inlet extends axially from one of the plurality of recesses to the lower end.

16. The drilling apparatus of claim 9, further comprising a filter module disposed in the housing and configured to filter the drilling fluid passing through the fluid port of the first component into one or more of the fluid inlets of the second component.

17. The drilling apparatus of claim 16, wherein the filter module is axially positioned between the control assembly and the first component.

18. The drilling apparatus of claim 16, wherein the filter module is configured to move with the first component.

19. The drilling apparatus of claim 9, wherein the cutting elements on each piston are arranged side-by-side in a row.

20. A method for drilling a borehole with a drill bit having a cutting structure, the method comprising:

(a) flowing drilling fluid through a housing to a fluid metering assembly, wherein the fluid metering assembly includes a first component moveable relative to a second component, wherein the first component includes a central bore and a fluid-metering opening, and wherein the second component includes a central bore and a plurality of fluid inlets;

(b) flowing drilling fluid through the central bore of the first component and the central bore of the second component into a central channel of the drill bit coupled to the housing;

(c) preventing the drilling fluid flowing through the central bore of the first component from flowing into each of the fluid inlets of the second component;

(d) moving the first component relative to the second component to divert a portion of the drilling fluid flowing through the central bore of the first component into all of the fluid inlets of the second component simultaneously;

(e) extending a plurality of circumferentially-spaced pistons radially outward from the drill bit in response to (d);

(f) reaming the borehole with a plurality of cutter elements of the pistons after (e).

21. The method of claim 20, further comprising:

filtering the portion of the drilling fluid diverted to all of the fluid inlets of the second component to remove at least some solids particles.

22. The method of claim 20, wherein the housing has a central axis, and wherein (d) comprises moving the first component axially relative to the second component.

23. The method of claim 20, further comprising:

rotating the first component relative to the second component to align the fluid-metering opening of the first component with one of the fluid inlets of the second component.

* * * * *